US007201366B2

(12) United States Patent
Sanders et al.

(10) Patent No.: US 7,201,366 B2
(45) **Date of Patent: *Apr. 10, 2007**

(54) ELECTRONIC WINCH MONITORING SYSTEM

(75) Inventors: Mark E. Sanders, Broken Arrow, OK (US); David E. Johnson, Coweta, OK (US)

(73) Assignee: Paccar Inc., Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/381,122

(22) Filed: May 1, 2006

(65) Prior Publication Data

US 2006/0192188 A1 Aug. 31, 2006

Related U.S. Application Data

(63) Continuation of application No. 10/888,948, filed on Jul. 9, 2004, now Pat. No. 7,063,306.

(60) Provisional application No. 60/507,754, filed on Oct. 1, 2003, provisional application No. 60/557,718, filed on Mar. 29, 2004.

(51) Int. Cl.
*B66D 1/08* (2006.01)

(52) U.S. Cl. ..... 254/361; 254/377

(58) Field of Classification Search ..... 264/361, 264/367, 377, 378, 386, 274, 275; 188/196 A; 303/DIG. 1, 41
See application file for complete search history.

(56) References Cited

U.S. PATENT DOCUMENTS 2,683,020 A 7/1954 Nickle
3,042,375 A 7/1962 Fahey et al.
3,572,482 A * 3/1971 Kalpas et al. ..... 192/15
3,674,119 A 7/1972 Worstell et al.

(Continued)

FOREIGN PATENT DOCUMENTS

EP 0387399 A2 9/1990

(Continued)

OTHER PUBLICATIONS

David Taylor, The great North Sea crane swap . . . , Business and Management Practices and Cranes Today, Apr. 2003, p. 42, ISSN: 0307-0018. Copyright 2003 Gale Group, Inc. and Copyright 2003 Wilmington Publishing Ltd., USA.

*Primary Examiner*—William A. Rivera
*Assistant Examiner*—Evan Langdon
(74) *Attorney, Agent, or Firm*—Howison & Arnott, L.L.P.

(57) ABSTRACT

An electronic winch monitoring system for a winch having a fixed-ratio gearbox with input and output shafts, a winch drum connected to the output shaft, and an auxiliary brake connected to the output shaft activated by reducing the pressure in a brake release hydraulic circuit. The system comprises an input shaft speed sensor, an output shaft speed sensor, and an electronic control unit having a monitoring section and a brake control section. The monitoring section receives the speed signals, processes them to produce a calculated ratio of actual input to output shaft speeds, and produces a fault indication signal when the value of the difference between the calculated speed ratio and the fixed ratio exceeds a predetermined value. The brake control section, upon receiving the fault signal, reduces the hydraulic pressure in the brake circuit using a nonlinear pressure-time profile to engage the auxiliary brake and stop the winch drum.

18 Claims, 12 Drawing Sheets

U.S. PATENT DOCUMENTS

| | | | | | |
|---|---|---|---|---|---|
| 3,685,290 | A | | 8/1972 | Krusche | |
| 3,850,380 | A | | 11/1974 | Kranefeld | |
| 4,093,939 | A | | 6/1978 | Mitchell | |
| 4,175,727 | A | * | 11/1979 | Clarke | 254/274 |
| 4,187,681 | A | | 2/1980 | Johnson | |
| 4,364,453 | A | | 12/1982 | Serina | |
| 4,448,394 | A | | 5/1984 | LeMoine | |
| 4,493,479 | A | * | 1/1985 | Clark | 254/274 |
| 4,565,007 | A | | 1/1986 | Issenmann | |
| 4,636,962 | A | | 1/1987 | Broyden et al. | |
| 4,854,547 | A | | 8/1989 | Oliphant | |
| 4,905,849 | A | | 3/1990 | Couli | |
| 5,117,992 | A | | 6/1992 | Simkus et al. | |
| 5,133,465 | A | | 7/1992 | Kalan | |
| 5,189,350 | A | | 2/1993 | Mallett | |
| 5,350,076 | A | | 9/1994 | Kalan | |
| 5,557,526 | A | | 9/1996 | Anderson | |
| 5,659,468 | A | | 8/1997 | Duss | |
| 5,671,912 | A | * | 9/1997 | Langford et al. | 254/267 |
| 5,692,733 | A | * | 12/1997 | Hiramatsu | 254/274 |
| 5,875,281 | A | | 2/1999 | Thexton et al. | |
| 5,992,655 | A | | 11/1999 | Greenberg et al. | |
| 6,079,576 | A | | 6/2000 | Bosler et al. | |
| 6,092,789 | A | * | 7/2000 | Christopher et al. | 254/274 |
| 6,097,165 | A | * | 8/2000 | Herron | 318/372 |
| 6,135,421 | A | | 10/2000 | Bartelme et al. | |
| 6,269,635 | B1 | * | 8/2001 | Zuehlke | 60/368 |
| 6,371,447 | B1 | * | 4/2002 | Imanishi et al. | 254/361 |
| 6,540,208 | B1 | * | 4/2003 | Pecot et al. | 254/134.4 |
| 6,644,629 | B1 | * | 11/2003 | Higashi et al. | 254/361 |
| 6,648,303 | B1 | * | 11/2003 | Nishimoto et al. | 254/361 |
| 6,739,677 | B2 | | 5/2004 | Tazoe et al. | |
| 6,966,544 | B2 | | 11/2005 | McCormick et al. | |
| 7,063,306 | B2 | * | 6/2006 | Sanders et al. | 254/361 |

FOREIGN PATENT DOCUMENTS

| | | | |
|---|---|---|---|
| EP | 1 371 600 | A2 | 12/2003 |
| JP | 10059688 | A | 3/1998 |
| JP | 10157977 | A | 6/1998 |
| JP | 11079680 | A | 3/1999 |
| JP | 11240689 | A | 9/1999 |

* cited by examiner

D1 AND D2 Ramps Ms vs Load
Adjusted fitted curve =
Ramp ms = 10,800,000 * Load ^ (-.9236)

HOIST
ESTIMATION
POWER(HOIST)
y = 1E+07x -0.9236
R2 = 0.9877
RAMP TIME (ms)
Load- lbs
0
2000
4000
6000
8000
10000
12000
14000
16000
18000
20000

D1 AND D2 Ramp Ms vs PsiD
CH230B y = 3.3E+06x -0.9226
R2 = 1
RAMP TIME (ms)
Winch DIFFERENTIAL Pressure
0.0
1000.0
2000.0
3000.0
4000.0
5000.0
0
2000
4000
6000
8000
10000
12000
14000
16000
18000
20000

ELECTRONIC WINCH MONITORING SYSTEM

CROSS REFERENCE TO RELATED APPLICATIONS

This application is a Continuation of U.S. application Ser. No. 10/888,948, filed Jul. 9, 2004, now U.S. Pat. No. 7,063,306, issued Jun. 20, 2006, entitled "ELECTRONIC WINCH MONITORING SYSTEM", which claims benefit of priority from U.S. Provisional Application No. 60/507,754, filed Oct. 1, 2003 and from U.S. Provisional Application No. 60/557,718, filed Mar. 29, 2004.

TECHNICAL FIELD OF THE INVENTION

The current invention relates generally to a control apparatus for a winch mechanism. More particularly, this invention relates to a control apparatus having electrical sensors that provide signals indicative of winch operating parameters to an electronic control unit that provides electrical control signals in response thereto.

BACKGROUND OF THE INVENTION

Winch and control systems are known which measure various winch operating parameters and produce control responses thereto. Two such systems are described in U.S. Pat. Nos. 4,187,681 and 6,079,576. These control systems do not provide all features sometimes desired for the safe and efficient operation of a winch.

A need therefore exists, for an improved electronic winch monitoring system which overcomes the disadvantages of conventional systems.

SUMMARY OF THE INVENTION

The present invention disclosed and claimed herein comprises, in one aspect thereof, an electronic winch monitoring system for a winch mechanism including a gearbox establishing a driving connection of predetermined fixed ratio between a rotatable input shaft and a rotatable output shaft, a primary brake including a plurality of interleaved friction plates and spacer plates operatively connected to the input shaft for selectively resisting rotational motion of the input shaft when activated, a rotatable winch drum operatively connected to the output shaft to rotate therewith for selectively winding on and winding off cable stored on the drum to hoist and lower loads, respectively, and an auxiliary brake including a plurality of interleaved friction plates and spacer plates operatively connected to the output shaft for selectively resisting rotational motion of the winch drum when activated by reducing a pressure in a brake release hydraulic circuit. The electronic winch monitoring system comprises an input speed sensor for detecting an actual rotational speed of the input shaft and producing input speed signals indicative of thereof. An output speed sensor is provided for detecting an actual rotational speed of the output shaft and producing output speed signals indicative thereof. An electronic control unit is provided including a monitoring section and a brake control section. The monitoring section receives the input and output speed signals, processes the speed signals to produce a calculated ratio of the actual rotational speed of the input shaft to the actual rotational speed of the output shaft, and produces a fault indication signal when the value of the difference between the calculated ratio and the predetermined fixed ratio exceeds a predetermined acceptable range value. The brake control section, upon receiving the fault indication signal, reduces the hydraulic pressure in the brake control circuit in accordance with a predetermined nonlinear pressure-time profile to engage the auxiliary brake and stop rotation of the winch drum.

DETAILED DESCRIPTION OF THE INVENTION

The current invention is described below in greater detail with reference to certain preferred embodiments illustrated in the accompanying drawings.

Figure 1:
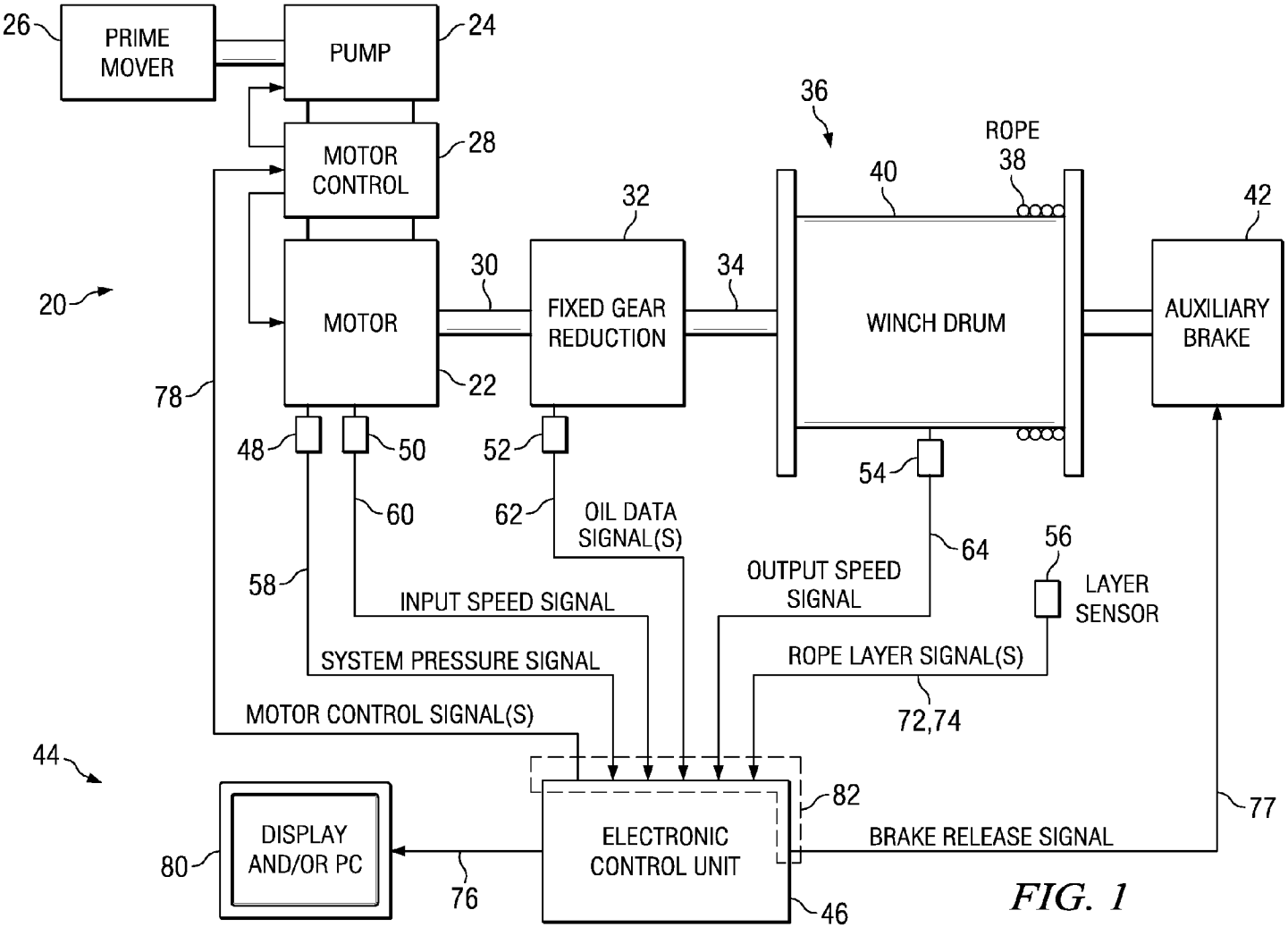
FIG. 1 is a schematic drawing of a winch mechanism including an electronic winch monitoring system in accordance with a first embodiment.

Referring now to FIG. 1, there is illustrated a schematic diagram of a winch mechanism equipped with an electronic winch monitoring system in accordance with one embodiment. A winch mechanism 20 includes a hydraulic motor 22 which receives hydraulic fluid from a hydraulic pump 24 powered by an internal combustion engine or other prime mover 26. Typically, the motor 22 and the pump 24 will be of the variable displacement type. The hydraulic motor 22 and the pump 24 may be connected to one another in either a closed-loop (i.e., hydrostatic) configuration or in an open-loop configuration, depending upon the application. A motor control unit 28 controls the speed, torque and direction of the motor 22 by changing the displacement of the motor and pump 24, and/or by modulating and redirecting the flow of hydraulic fluid from the pump to the motor.

The output shaft 30 of the hydraulic motor 22 drives the input of a reduction gear unit 32, and the output shaft 34 of the reduction gear unit is connected to a winch drum 36. The reduction gear unit 32 typically has a fixed gear ratio such that the speed of the gear box output shaft 34 (and hence, of the winch drum 36) will be at a fixed ratio to the speed of the input shaft 30. A quantity of wire rope or cable 38 is wound onto a hub 40 of the winch drum 36. The rope 38 typically lies on the hub 40 in concentric layers, each layer having a thickness equal to the rope's diameter. An auxiliary brake 42 is operably connected to the winch drum 36 such that activation of the brake will stop rotation of the drum and thereby hold a load supported by the rope 38. The auxiliary brake 42 is typically of the "normally on" or "fail safe" type which is activated by springs and requires powered control inputs (e.g., hydraulic) to release.

The winch mechanism 20 is provided with an electronic winch monitoring system 44 which monitors various operational parameters of the winch system during operation and provides information to the operator and/or control outputs to the winch. The monitoring system illustrated in FIG. 1 comprises an electronic control unit ("ECU") 46, a system pressure sensor 48, an input speed sensor 50, an oil data sensor 52, an output speed sensor 54 and a rope layer sensor 56. The ECU 46 includes a programmable memory unit for storing instructions and data, a processor unit operably connected to the memory unit for executing instructions retrieved from the memory unit, at least one input port operably connected to the processor unit for receiving electrical sensor signals from external sensors, and at least one output port operably connected to the auxiliary brake 42, motor control unit 28, or other devices for transmitting electrical control signals thereto. The ECU 46 is typically a microprocessor-based device, and preferably it may be interfaced with a PC-type computer 80 for programming and data transfer purposes. The input and output ports (denoted generally by reference number 82) may include analog-to-digital, digital-to-analog and/or digital-to-digital conversion and isolation circuitry.

The system pressure sensor 48 senses the input pressure to the hydraulic motor 22 and provides a system pressure signal 58 to the ECU 46. The motor input pressure sensed by the system pressure sensor 48 will typically be proportional to the load on the winch drum 36. In the illustrated embodiment, the system pressure sensor 48 is a pressure transducer sending a variable electronic signal 58 to the ECU 46. In other embodiments, different types of known sensors may be used, including those having a digital output, a mA current output, pulse width modulation output, etc.

The input speed sensor 50 measures the speed of the motor output shaft 30 and sends an input speed signal 60 to the ECU 46. In the embodiment illustrated, the input speed sensor 50 is a magnetic (e.g., Hall-effect) sensor and the signal 60 is a digital signal, however, other types of known speed or flow sensors may be used. It will be appreciated that the input speed may also be measured at the reduction gear unit input.

The oil data sensor 52 is positioned with access the lubricating oil in the reduction gear unit 32. The oil data sensor 52 measures the temperature of the lubricating oil (e.g., using a thermocouple) and/or the oil quality or contamination level (e.g., using ultrasonic, conductivity or phototransmissivity measurements) and sends oil data signals 62 to the ECU 46. The oil data signals 62 may be of analog or digital types depending on the nature of the sensors used.

The output speed sensor 54 detects the speed of the gear reduction unit output 34 or the winch drum 36 and provides an output speed signal 64 to the ECU 46. In the illustrated embodiment, the output speed sensor is a Hall-effect magnetic sensor which detects the rotation of the winch drum. Other types of known speed sensors may be used for the output speed sensor 54.

Figure 2:
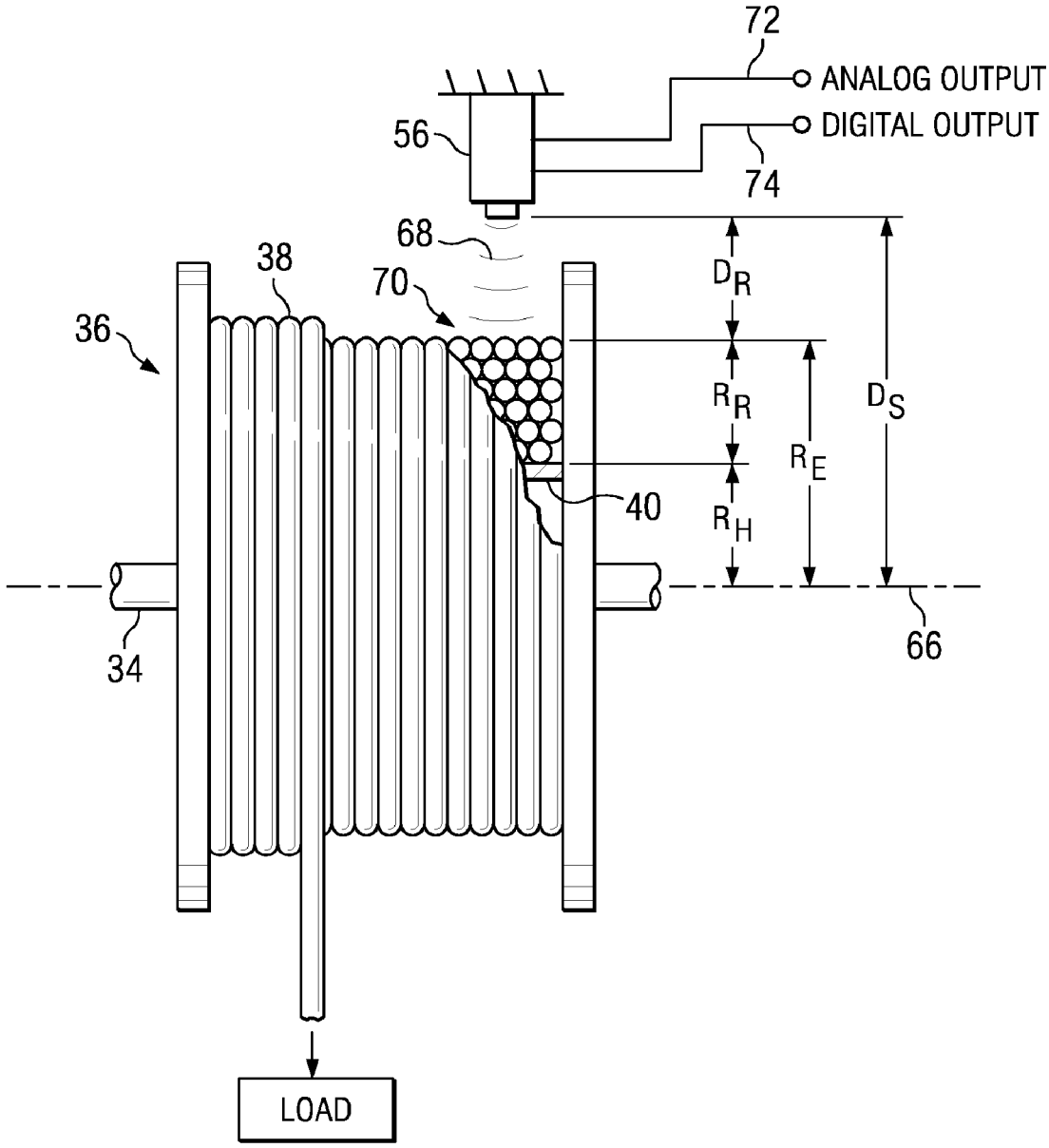
FIG. 2 is an enlarged view, with portions broken away, of the mechanism of FIG. 1, illustrating the operation of the rope layer sensor.

Referring now to FIG. 2, there is illustrated an enlarged view of the winch drum 36 showing operation of the rope layer sensor 56. To effectuate certain control modes, e.g., constant pull/constant load, it is necessary to know the moment arm of the winch mechanism, also known as the effective drum radius, denoted $R_E$. The effective drum radius is the sum of the hub radius (denoted $R_H$), a fixed value, and the incremental radial thickness of the winch rope (denoted $R_R$), i.e., the distance from the drum hub 40 to the top layer of rope 38. It will be appreciated that the value of $R_R$ changes as the concentric layers of rope 38 are wound and unwound from the drum 36. One aspect of the current invention is a direct measuring rope layer sensor 56 which measures the radial thickness $R_R$ of the rope currently on the winch drum 36. In the embodiment shown in FIG. 2, the rope layer sensor 56 is an ultrasonic distance sensor mounted a known distance (denoted $D_S$) from the axis 66 of the winch drum. The rope layer sensor 56 operates by emitting a series of ultrasound pulses 68 which reflect from the upper surface 70 of the wire rope 38 back to the sensor. Circuitry within the rope layer sensor 56 calculates the distance (denoted $D_R$) between the sensor and the wire rope 38 based on the elapsed time required for the ultrasonic signal to travel from the sensor to the wire surface 70 and return. The sensor 56 than transmits rope layer signals 72, 74 indicative of the distance $D_R$ to the ECU 46.

It will be appreciated that once the distance $D_R$ between the sensor and the upper surface of the rope is known, the ECU 46 can calculate the effective winch radius $R_E$ by subtracting the distance $D_R$ from the previously known distance $D_S$ between the sensor and the winch axis. Once the radius $R_E$ is known, the ECU 46 can further calculate the radius $R_R$ by subtracting the previously know hub radius $R_H$ from $R_E$. Using $R_R$ and the diameter of the rope 38, the ECU 46 can calculate the current rope layer. Any and/or all of these parameters may be displayed to the operator on a computer or monitor 80 attached to the ECU 46.

It will be appreciated that when the rope 38 is being wound on and off the winch drum 36, there may be two rope layers exposed on different portions of the hub 40. Since the rope layer sensor 56 in the illustrated embodiment is directed at only one portion of the winch drum 36, the sensor's accuracy will be only about +/− one layer. This accuracy is acceptable for most applications, and in any event, is preferable to calculating loads based on a fixed average effective hub radius. If, however, higher accuracy is required, then multiple rope layer sensors 56 may be employed. For example, if two rope layer sensors 56 are used, one placed at each end of the winch drum 36, the ECU 46 can determine the exact rope layer currently in use.

It will further be appreciated, that although an ultrasonic distance measuring device is employed for the rope layer sensor 56 in the illustrated embodiment, alternative embodiments may utilize other rangefinder-type distance-measuring technologies for the layer sensor, including photoelectric sensors, magnetic induction sensors, laser rangefinders, and radar rangefinders.

An ultrasonic distance measuring sensor suitable for use as the rope layer sensor 56 is the "Toughsonic 168" produced by Senix Corporation. The Toughsonic 168 sensor can provide both analog signals 72 and digital output signals 74. It provides analog voltage signals 72 which are proportional to the distance being measured, e.g., the distance $D_R$ between the sensor and the top layer of rope. It can also provide digital signals indicating when a preset maximum or minimum value for distance has been reached. The maximum and/or minimum distance values may be programmed into the rope layer sensor by "teaching", i.e., by activating the sensor in a first setting mode when the rope layer is at a minimum acceptable distance causing the sensor 56 to record its current distance measurement and store it as the minimum limit point, or activating the sensor in a second setting mode when the rope layer is at the maximum acceptable distance causing the sensor to record its current measurement and store it as the maximum limit point. After teaching, the sensor 56 will send a digital signal 74 to the ECU 46 if either limit point is exceeded.

The electronic winch monitoring system is capable of performing a number of monitoring and control functions as follows:

Gear Train Monitoring—By sensing the input speed signal 60 from the winch motor 22 or gear reduction input 30 and the output speed signal 64 from the winch drum 36 or gear box reduction output 34, the ECU 46 can calculate the ratio of input speed to output speed and determine whether the calculated ratio is consistent with the previously known ratio of the gear reduction unit 32. If the sensed speed ratio from the input and output speed sensors is not within a preset range, the ECU 46 will send brake actuation signals 77 to the auxiliary brake 42, causing the brake to stop the winch drum 36. A signal may also be sent to the winch operator indicating a fault.

Drum Over Speed Monitoring—By sensing the output speed signal 64 from the winch drum 36 or gear reduction output 34, the ECU 46 can compare the measured speed to a preset maximum allowable speed for the winch drum. If the signal from the drum sensor 54 exceeds the maximum allowable speed for the winch drum 36, the ECU 46 will signal the auxiliary brake 42 to stop the winch drum 36 and signal the winch operator of the fault.

Minimum Rope Indicator—By sensing the rope layer signals 72 and/or 74 from the rope layer sensor 56 as the rope 38 is spooled off the drum 36, the ECU 46 can determine when a minimum number of wraps of rope are left on the winch drum. The ECU 46 will in turn signal the winch operator and/or disable the winch system using the auxiliary brake 42 when the preset minimum amount of rope is reached.

Dynamic System Monitoring—The various measured system parameters including system pressure signal 58, input speed signal 60, oil data signals 62, output speed signals 64, rope layer signals 72 and 74, can be converted by the ECU 46 into standardized units, and this data 76 can be sent by the ECU 46 to a display or PC 80 for viewing by the operator for logging purposes.

Winch Duty Cycle Histogram—The ECU 46 monitors and stores information related to the system input and output speeds, hydraulic system pressure and the number of winch operating hours. This stored information can be displayed in a histogram on the display 80 to allow the operator or technician to determine the severity and duration of winch operation. The stored information can also display the peak operating parameters that the winch has experienced.

Constant Speed and/or Constant Load Operation—By sensing the input or output speed signals 60, 62, the system pressure signal 58, and the rope layer signal 72, the ECU 46 can calculate the load (i.e., pull) on the rope 38 and/or the speed of the rope. If it is desired to hold these parameters constant, then the ECU 46 can issue motor control signals 78 which are routed to the motor control 28 so as to change the displacement and/or speed of motor to maintain the desired constant performance.

Winch Data Storage—The memory unit of the ECU 46 can be used to store basic information related to the winch for future access by winch service personnel. This information may include, without limitation, winch model number, winch serial number, data winch shipped from factory, maximum allowable system pressure and flow, maximum allowable winch line pull and speed at various rope layers, along with other winch application data.

Winch Service Interval Information—The ECU 46 can monitor winch operations via the sensors previously described and determine how often servicing of the winch is required based on the number of operating hours, severity of duty cycle and/or by monitoring gear oil temperature and contamination levels.

In another embodiment, the invention comprises a control system for a winch auxiliary brake. In contrast to the primary brake (also known as the "parking brake"), which is typically connected to the motor or input shaft on the input side of the reduction gearing, the auxiliary friction brake is attached directly to the winch drum such that its braking is totally independent of, and redundant to, any retarding action from the primary winch brake, hydraulic motor and counterbalance valve and/or a closed loop hydraulic drive where the retarding power is transmitted back to the prime mover (diesel engine, electric motor, etc.). This auxiliary brake is typically capable of holding the full rated static winch load, and is further able to stop dynamic loads within the designed torque and energy limits of the auxiliary brake design. The purpose of this auxiliary brake is to stop and hold the load in case of a winch gearing failure, or failure of the primary brake and loss of hydraulic braking, either from the motor and counterbalance or from the retarding action of the prime mover.

One notable application of auxiliary brake equipped-winches is the transportation of personnel on off-shore drilling applications or tower erection applications. Typically in these personnel lifting applications, a "man-basket" device is hoisted by the winch to transfer workers from a drilling platform to a work boat, or to transport workers up and down the tower. In this discussion, the term "man-basket" refers to any device which is attached to the winch line and intended primarily for transporting persons. The weight of these man-baskets may range from an empty weight of 500 pounds to a loaded weigh of roughly 350 pounds per person with tools plus the man-basket weight. Thus, most man-baskets have a rated capacity of three to six people or a maximum of 2600 pounds more or less. In contrast, typical hoist capacities used in such off-shore and construction applications will range from 15,000 pounds to 64,000 pounds bare drum line pulls and higher.

When comparing the man-basket loads to the winch capacities, it becomes apparent that the typical auxiliary brake has a much higher capacity than required for man-basket loads. Furthermore, these auxiliary brakes, whether mechanically (e.g., spring) applied and hydraulically released, or normally released and mechanically/hydraulically applied, may be difficult for an operator to modulate precisely by a manual means. Accordingly, if the crane operator or a conventional automatic braking system applies the auxiliary brake too quickly, personnel being transported by the winch in a man-basket may experience uncomfortably high, or even dangerously high, G forces. On the other hand, if the crane operator applies the brake late or too slowly, the personnel being transported in a man-basket may impact the surface below. Currently, the commercially available winches with auxiliary brakes utilize a simple "on/off" hydraulic control valve, and possibly hydraulic line orifices, to attempt to control severe brake applications. However, such control means have a tendency to vary the stopping characteristics of the brake depending on variations in hydraulic temperatures, line loads and line speeds resulting in a narrow optimum conditions.

Figure 3:
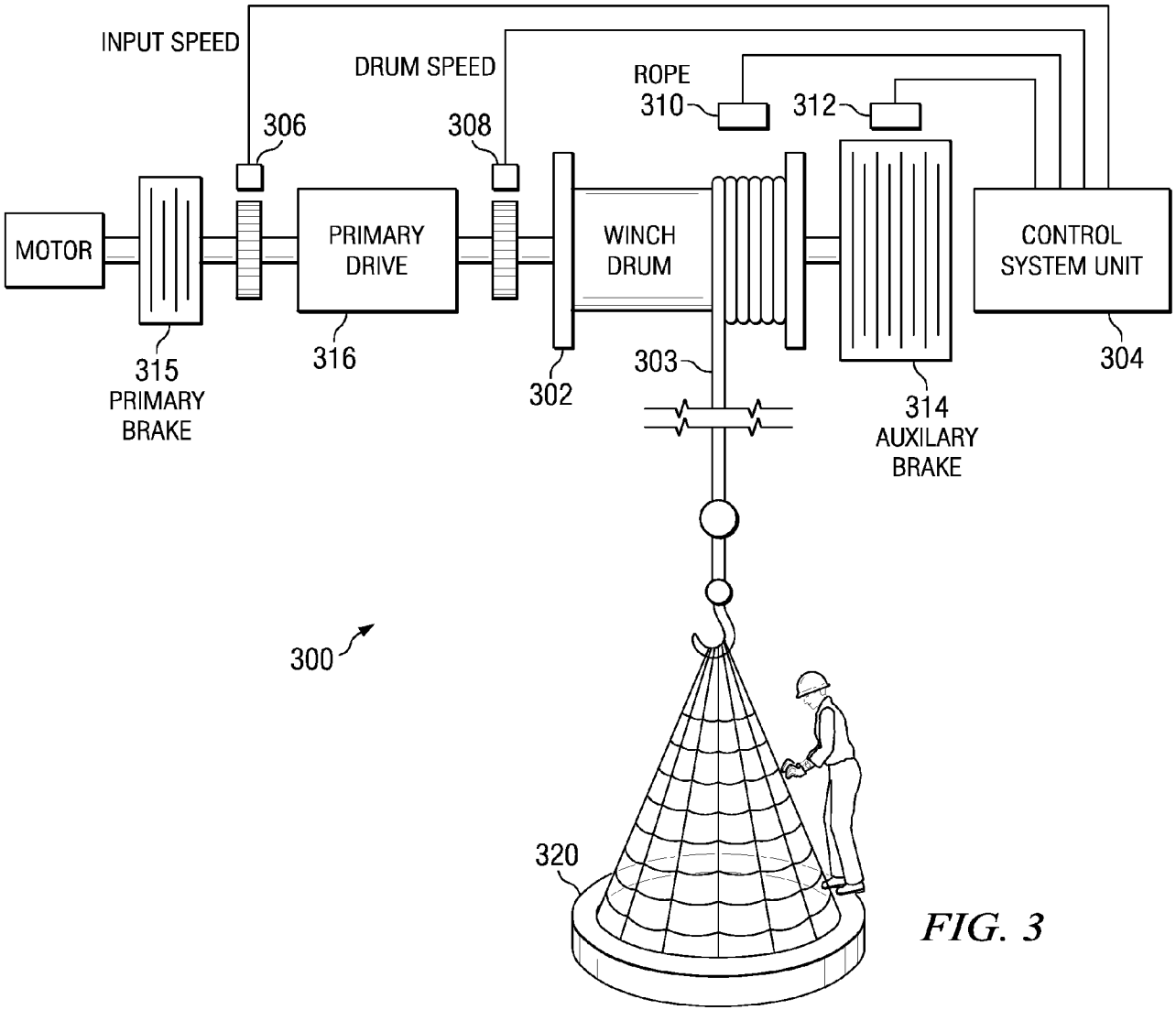
FIG. 3 is a schematic drawing of a winch mechanism including an electronic winch monitoring system in accordance with another embodiment.

Referring now to FIG. 3, there is illustrated a control system (termed an "Electronic Winch Monitoring System" or "EWMS") for a winch auxiliary brake in accordance with another embodiment. By monitoring the winch operation parameters with sensors as previously described and further described herein below, the EWMS may be suitable for man-basket hoisting, among other applications. In particular, FIG. 3 shows a hoisting winch 300 with drum 302 equipped with an EWMS 304 having a processor and memory (not shown) and operably connected to winch parameter sensors, e.g., input (motor) speed sensor 306, output (drum) speed sensor 308, rope layer sensor 310 and an auxiliary brake 314. A parking brake 315 is provided on the input side of the primary (i.e., reduction gearing) drive 316. The EWMS 304 is capable of detecting a failure in the winch system, either a discontinuity in the winch power train 316 and retarding system, or the winch exceeding maximum, preset speed limits. The EWMS system 304 may be equipped to electronically control a pressure and/or flow from a solenoid valve 312 to give a predetermined and repeatable modulated hydraulic pressure signal to release and reapply the auxiliary brake 314. The EWMS 304 may further be adapted to continuously sense operational parameters of the winch (e.g., actual load, speed and line direction (hoist or lower), amount of rope on the drum) and maintain data regarding these conditions in its memory (at least temporarily) such that, should a failure occur, the conditions prior to the time the failure occurred would be known.

The EWMS 304 maybe programmed to automatically apply the auxiliary brake 314 in a manner to provide a controlled and planned stopping distance based on the conditions (stored in memory) just prior to a winch failure, thereby reducing the danger of the load (e.g., man-basket 320) impacting the ground or a structure below. Further, the EWMS 304 may be programmed to automatically apply the auxiliary brake 314 in a manner that limits the maximum accelerations (i.e., "G-forces") on the load 320 so that the stopping action itself will not injure personnel in the man-basket from excessive G-forces, nor cause them to be thrown off of the man-basket because they could not hold on adequately. The EWMS system 304 may sense and evaluate multiple load, speed and direction conditions and automatically determine the timing and strength of the braking action needed to limit G-forces to acceptable levels while limiting maximum stopping distance to reasonable distances that would be expected to be available based on the operator-selected line speed just prior to the failure. While not required, the EWMS 304 may also determines the stopping distances based on a programmed equation or matrix of values in the EWMS memory that have previously been derived and tested. Such function has the advantage of allowing the auxiliary brake equipped winch to successfully and optimally be applied across a much broader range of loads, speeds and hoist/lower direction. In doing this, the EWMS 304 not only optimizes the conditions in man-basket load levels but extends the benefit of a more controlled application to significantly higher winch load and speeds until the load is stopped or the auxiliary brake dynamic rating is exceeded.

Thus, an electronic winch monitoring system is provided for a winch mechanism 300 including a hydraulic or electric motor, a fixed gear reduction 316, a winch drum 302, a length of wire rope 303 wound onto the winch drum in a plurality of concentric layers and an auxiliary brake 314. The electronic monitoring system comprises an electronic control unit 304 for receiving electrical signals indicating actual winch speed, hoist/lower direction and load conditions and the signal transducers (e.g., sensors 306, 308 and 310) necessary to generate these signals. Base on the signal received just prior to a gear train failure or other problem, the electronic monitoring system 304 determines the optimum control system parameters based on maintaining low stopping G-forces and minimizing stopping distances. Furthermore, this electronic control unit 304 may be programmed such that it looks at an equation or matrix of values in memory and determines the optimum stopping distance over a much wider operation range of load, speed and hoist/lower direction than a single stopping parameter values would allow.

Figure 4:
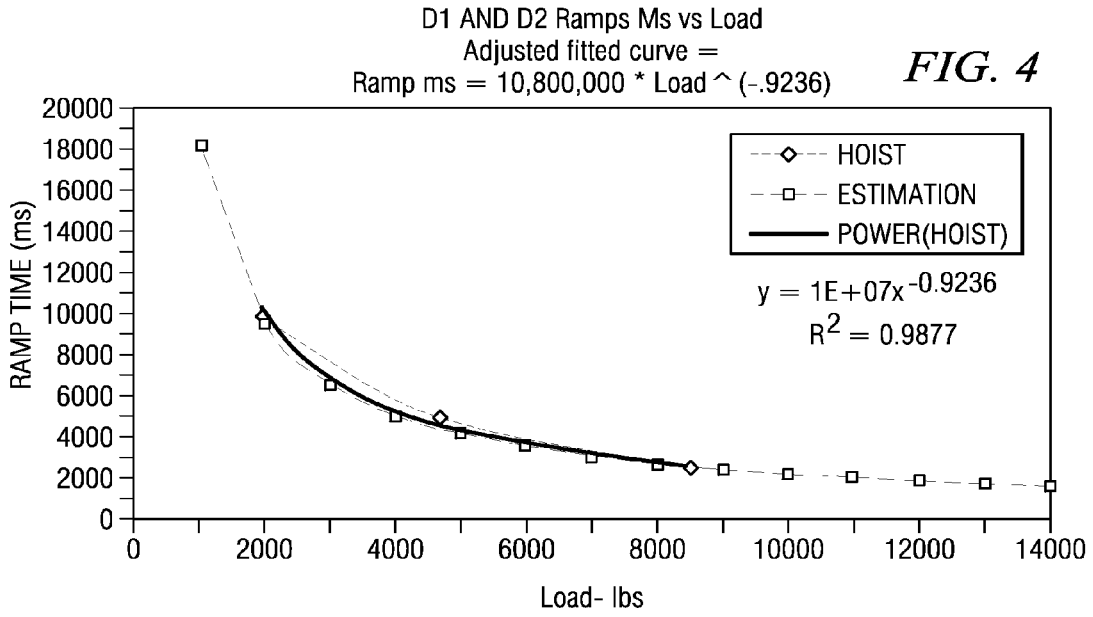
FIG. 4 is a graph of load versus ramp time for a first control algorithm in accordance with a further embodiment.
Figure 5:
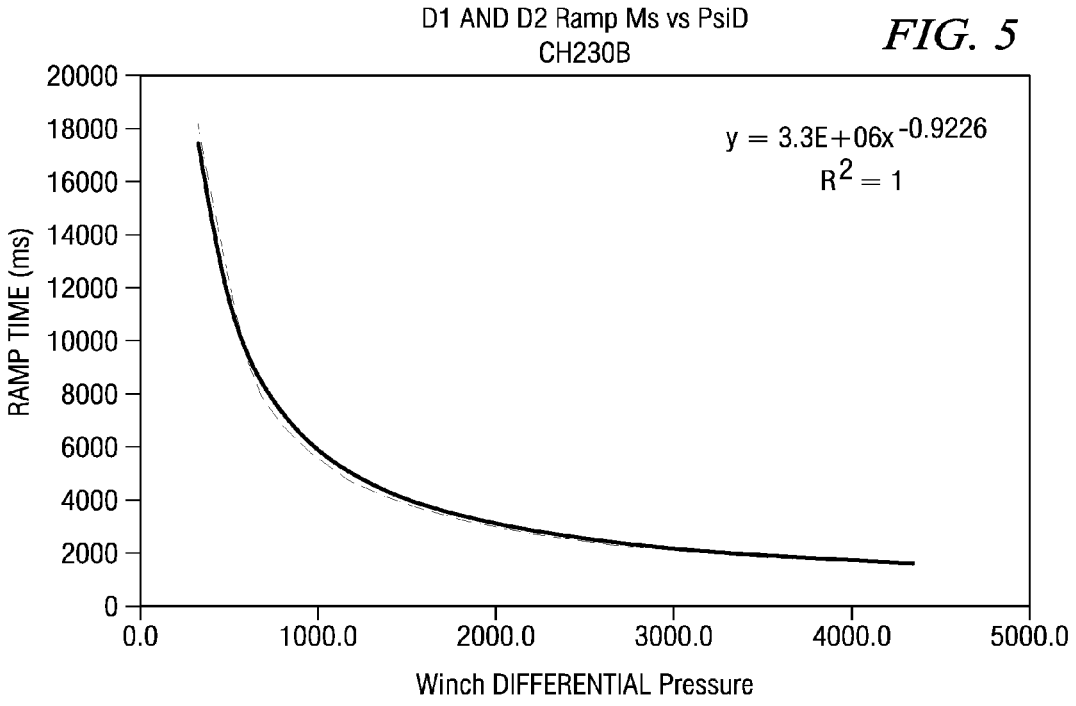
FIG. 5 is a graph of winch differential pressure versus ramp time for a second control algorithm in accordance with yet another embodiment.

Referring now to FIGS. 4 and 5, examples of equations believed useful in the electronic control unit 304 are provided along with graphs of winch load and winch differential pressure, respectively, versus ramp time for selected inputs. The equations are for what is know as the "ramp curve." It is believed desirable to drop from the fully released pressure and then replace the D1 & D2 ramps with a single equation. The base equation needs to look at a f(l) load function and a second f(v) velocity knowing both the differential pressure across the winch motor ports, and the winch drum travel direction (i.e., "hoist"or "lower"). It is expected that load is the dominant variable with velocity secondary. Also, high load/speeds are of lesser concern since the auxiliary brake is typically limited to 150% of static maximum drum torque, and consequently may exceed the maximum brake capacity resulting from plate slippage when the brake release pressure (signal) is at 0 psi. This condition will limit maximum stopping torque and subsequently limit max G forces at the expense of increasing stopping distances at higher load-speed conditions.

The following equations are proposed to replace both D1 & D1 as a single setup variable:

$$\text{ramp time}=f(l)*f(v) \tag{1}$$

where the ramp time is in ms, and the load variable f(l) is given by:

$$f(l)=3.3E6*D^{(-0.9226)} \tag{2}$$

where D is the differential pressure (in psi) across the motor, and where the differential pressure value is "clamped" during the brake apply process. The current hoisting pressure (if hoisting), or the last hoisting pressure (if lowering) must be selected. It may be desirable to use an averaged pressure versus an instantaneous pressure, to avoid data that represents only a high or low pressure spike.

It will be appreciated that the velocity variable f(v) needs to be direction dependent. If hoisting, f(v) is always set at 1.000, while if lowering, f(v) is calculated based on the velocity immediately prior to sensing a fault. This is because, while hoisting, gravity helps to stop the load, whereas in lowering, the ramp time needs to be extended at high speeds to limit top end G-forces. Thus, the following equations are proposed:

$$f(v)_{hoisting}=1 \tag{3a}$$

$$f(v)_{lowering}=(1+[\text{fpm}/500]*\text{velocity factor }\%) \tag{3b}$$

where fpm is the drum speed (bare drum) in ft/min, and the velocity factor is between 0 to 200%. For example, where fpm is 259 and velocity factor f(v)=140%, then:

$$f(v)=(1+[259/500]*140\%)=1.7252 \quad (4)$$

The curves shown in FIGS. 4 and 5 were used in determining the load equations.

Figure 6:
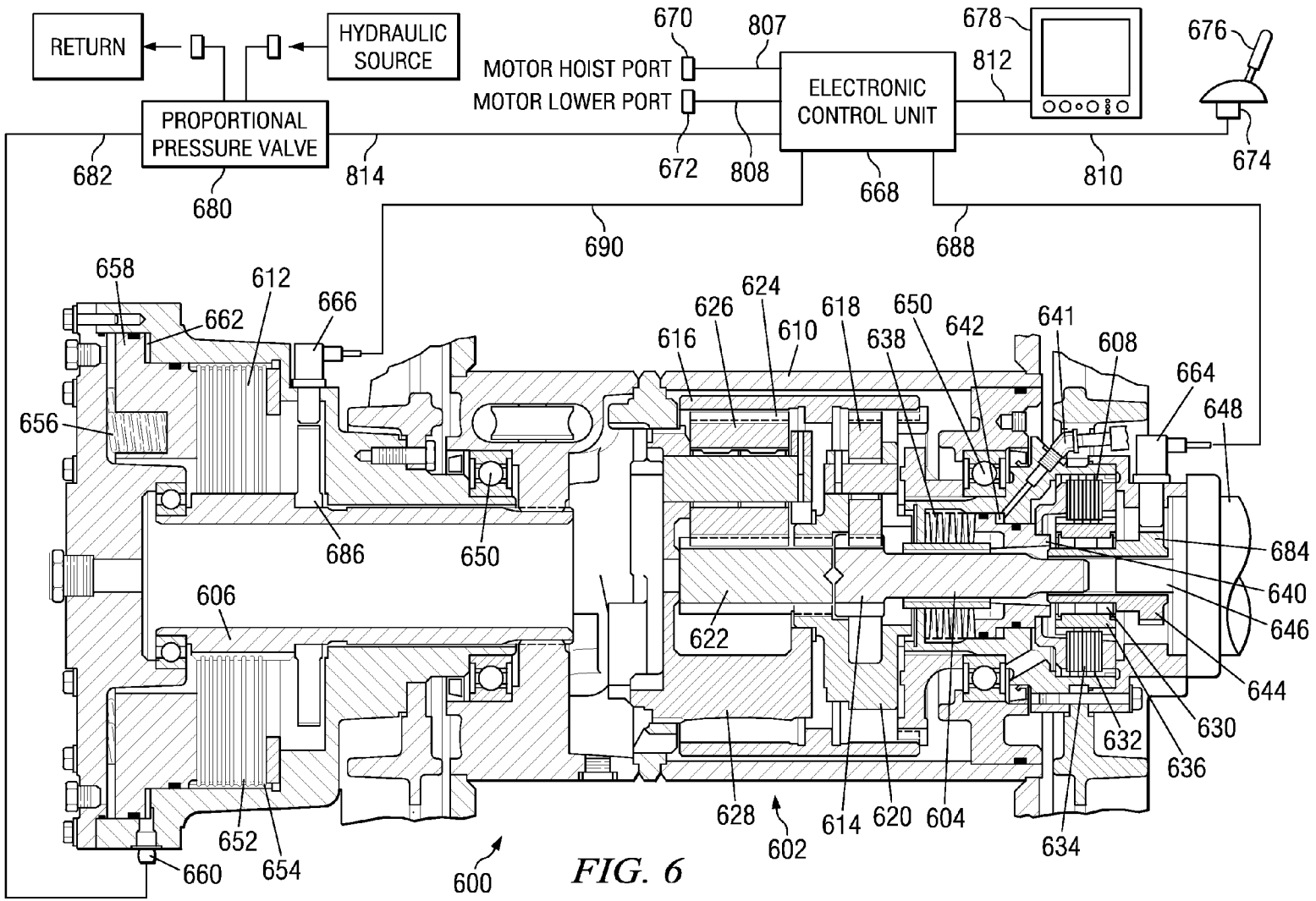
FIG. 6 is cross-sectional view with schematic diagram of a winch including a electronic winch monitoring system in accordance with another embodiment.

Referring now to FIG. 6, there is illustrated a winch equipped with an electric winch monitoring system in accordance with another embodiment. It will be appreciated that the winch 600 is of conventional design in many respects, having a gear box 602 that provides a fixed ratio between the revolutions (and hence also between the speed) of an input shaft 604 and an output shaft 606, a primary or "parking" brake 608 connected to the input shaft, a winch drum 610 connected to the output shaft and an auxiliary brake 612 also connected to the output shaft and the winch drum. In the illustrated embodiment, the gear box 602 is a two-stage planetary drive including a primary sun gear 614 driven by the input shaft 604, a ring gear 616, planet gears 618 revolving in a carrier 620, a secondary sun gear 622, secondary ring gear 624 and secondary planet gears 626 revolving in a secondary carrier 628 which drives the output shaft 606. The operating principles of such planetary gear drives are well known and will not be further described herein. It will be appreciated that other types of gear trains, including those using spur gears, helical gears, worm gears or combinations of these, may be used in the gear box of this invention as long as the drive produces a fixed ratio between the revolutions of the input shaft and the output shaft.

The parking brake 608 serves to resist rotation of the input shaft 604 in the lowering direction when activated. The parking brake typically includes a one way sprag clutch 630, and a plurality of interleaved friction plates 632 and spacer plates 634. The plates 632 and 634 are keyed to be rotationally locked to the input shaft and winch housing, respectively, that are free to move axially along the brake hub 636. When activated, the plates 632 and 634 are pressed firmly together to rotationally lock the input shaft 604 to the fixed housing. When a sprag clutch 630 is included, this locking effect occurs only in the lowering direction, and the input shaft 604 remains able to "turn through" the parking brake when rotating in the hoisting direction.

For fail-safe operation, the parking brake 608 is typically spring applied and hydraulically released. In the embodiment shown, the brake is activated by springs 638 which press against annular piston 640 to compress the plates 632 and 634 against one another. The brake is released by feeding pressurized hydraulic fluid via port 641 into an annular hydraulic cavity 642 formed between the piston 640 and the winch housing, thereby forcing the piston back against the bias of springs 638 and allowing the plates 632 and 634 to move apart.

As indicated, the parking brake 608 is rotationally connected to the input shaft 604. In some cases, the brake 608 is mounted directly on the input shaft itself, while in other cases, intermediate elements may be involved. For example, in the embodiment shown, the parking brake 608 is mounted on a motor adaptor 644 which interconnects the output shaft 646 of the winch motor 648 to the input shaft 604.

The winch drum 610 is directly connected to the output shaft 606 for selectively winding on (i.e., hoisting) and winding off (i.e., lowering) cable (not shown) stored on the drum. Large bearings 650 are provided between the drum 610 and the winch housing 601 to support the loads encountered.

Since the winch drum 610 is fixedly connected to the output shaft 606, the rotational speed of both will be the same, and this common output speed will maintain a fixed ratio with the rotation speed of the input shaft 604, provided the gear box 602 remains intact.

Also connected to the output shaft 606 is the auxiliary brake 612. As with the parking brake, the auxiliary brake 612 is typically spring applied and hydraulically released in order to provide fail-safe operation. However, unlike the parking brake, no one way clutch is provided, therefore, the auxiliary brake 612 can resist rotation of the output shaft 606 and winch drum 610 in both the hoisting and lowering directions. Because the auxiliary brake 612 must handle considerably higher loads than those of the parking brake 608, the components of the auxiliary brake are typically much larger. In most other respects, however, the components of the auxiliary brake 612 are similar to those of the parking brake 608. In particular, the auxiliary brake 612 includes a plurality of interleaved friction plates 652 and spacer plates 654. The plates 652 and 654 are keyed to be rotationally locked to the output shaft 606 and winch housing 601, respectively, that are free to move axially along the output shaft. When activated, the plates 652 and 654 of the auxiliary brake 612 are pressed firmly together to rotationally lock the output shaft 606 to the fixed housing 601. In the embodiment shown, the auxiliary brake 612 is activated by springs 656 which press against an annular piston 658 to compress the plates 652 and 654 against one another. To release the brake, hydraulic fluid is fed through a port 660 into an annular cavity 662 formed between the piston 658 and the housing 601, thereby forcing the piston back against the bias of the spring 656 and allowing the plates 652 and 654 to move apart.

The winch 600 is equipped with an electronic winch monitoring system ("EWMS") which includes a number of components disposed at various locations on the winch itself and in other locations such as the operator's station. The EWMS components include an input speed sensor 664, an output speed sensor 666, and an electronic control unit 668. The EWMS may further include a pressure sensor 670 on the motor "HOIST" port, a pressure sensor 672 on the motor "LOWER" port, a winch direction sensor 674 detecting whether the operator controls 676 are in "HOIST" or "LOWER" position, an operator display 678 and a hydraulic proportional pressure valve 680 for controlling the pressure in the auxiliary brake release hydraulic circuit 682.

In the embodiment shown, the input and output speed sensors 664 and 666 are Hall-effect type sensors which sense the rotation of nearby toothed sensor disks and produce a "pulsed" output signal indicative of the respective input or output shaft speeds. In this case, the input sensor disk 684 is formed on a motor adaptor 644, and the output sensor disk 686 is mounted directly on the output shaft between the winch drum 610 and the auxiliary brake 612. The speed signals are transmitted from the input speed sensor 664 and the output speed sensor 666 to the electronic control unit 668 via electrical lines 688 and 690 respectively. It will, of course, be appreciated that other forms of speed sensors may be substituted for the Hall-effect type sensors used in the embodiment shown. It will also be appreciated that the location of the input and output speed sensors may vary from those shown herein as long as they provide a reliable indication of the actual speed of the input shaft and the output shaft respectively.

Figure 7:
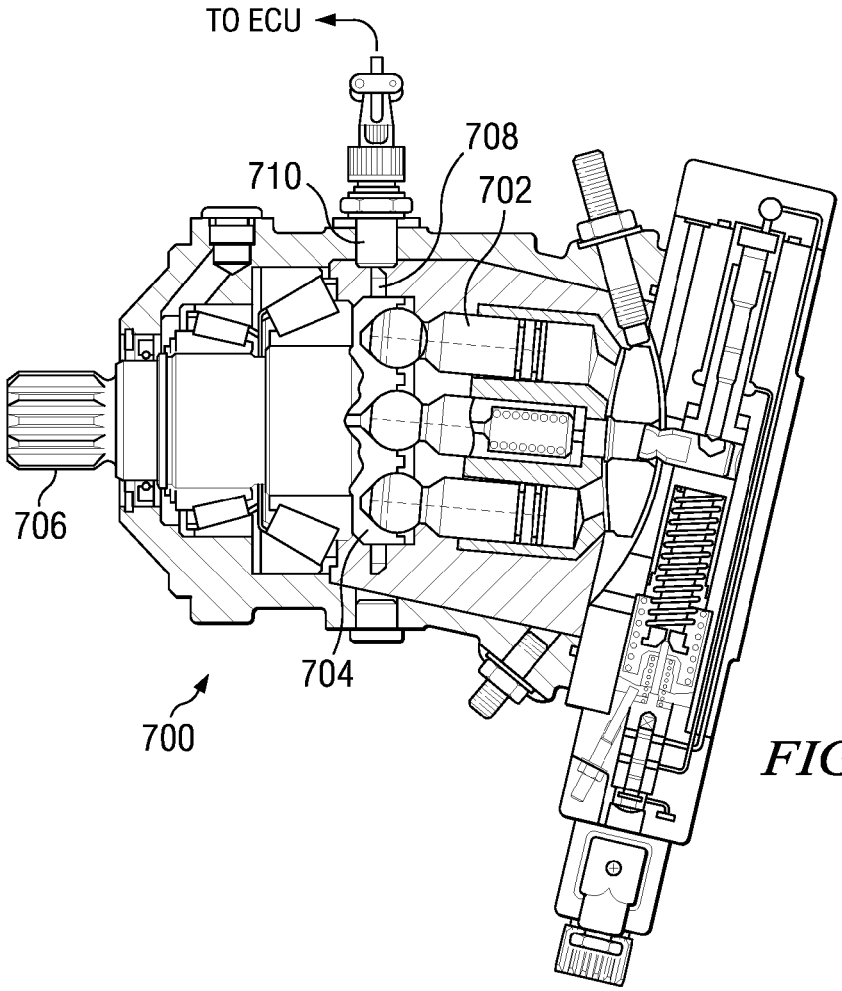
FIG. 7 is a hydraulic motor with speed sensor for use in alternative embodiments of the electronic winch monitoring system.

For example, referring now to FIG. 7, there is illustrated a hydraulic motor for use on a winch having an alternative electronic winch monitoring system. The hydraulic motor 700 includes positive displacement pistons 702 driving a rotor 704 in a conventional arrangement. The motor output shaft 706 is driven by the rotor 704 and adapted for connection to the input shaft of a winch similar to that shown in FIG. 6. In this case, however, the rotor 704 of the pump 700 is equipped with a toothed wheel 708 and a Hall-effect type speed sensor 710 suitable for measuring the rotational speed of the rotor output shaft 706. When a speed sensor equipped motor of this type is connected to a winch similar to that shown in FIG. 6, the output of the motor's speed sensor 710 may be used by the EWMS in lieu of a separate speed sensor mounted on the input shaft as was shown in FIG. 6. Depending upon the particular configuration of the winch, it may be advantageous to utilize a motor mounted input speed sensor as opposed to modifying the winch design to include a winch mounted sensor as previously disclosed.

As previously described, the electronic winch monitoring system may perform a number of functions and provide a variety of useful information to the operator. One function previously mentioned and now herein further explained is the detection of winch gear train failures and the automated reaction which occurs when such gear train failure is detected. This automated reaction includes stopping the drum's rotation using the auxiliary brake, controlling the brake application rate so as to avoid excessive G forces while stopping, diagnosing the gear train's condition after a fault detection to determine if there has been a true gear train failure or simply a false positive indication before returning control to the operator, and finally logging the results and performance of the tests for future records.

In winches having a gearbox with a fixed gear ratio, almost all serious gear train (i.e., "G.T.") failures result in at least a partial uncoupling of the input shaft from the output shaft. In other words, once a failure occurs, the input and output shafts no longer move with their original constant fixed ratio. Thus, the EWMS of this invention utilizes the so-called "speed ratio", i.e., the ratio of the input shaft speed to the output shaft speed, as a convenient indication of possible gear train failure.

Figure 8:
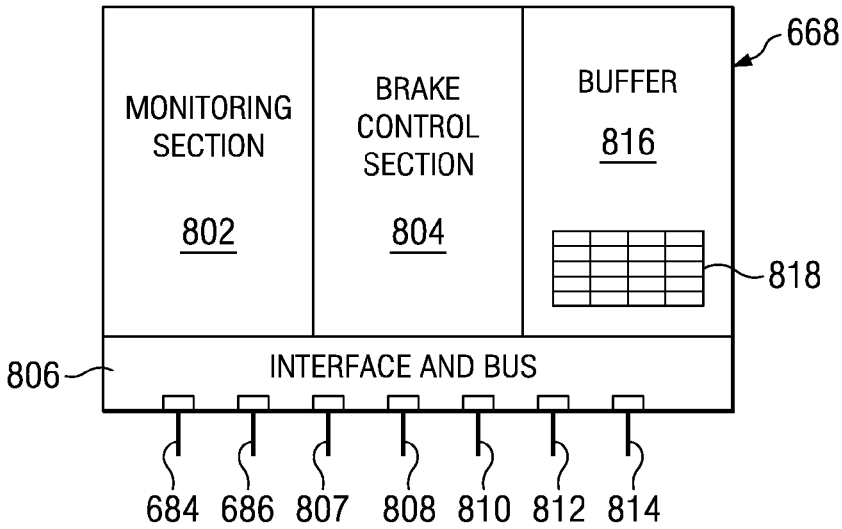
FIG. 8 is a schematic diagram of the electronic control unit for the electronic winch monitoring system.

Referring again to FIG. 6 and referring now also to FIG. 8, the structure and operation of the electronic control unit 668 will be further described. The electronic control unit 668 includes a monitoring section 802, a brake control section 804, and interface and bus section 806 required for internal communication between the various sections and with external communication with various sensors and devices being controlled. For example, signal lines 688 and 690 from the input and output speed sensors, respectively, are connected to the electronic control unit as well as signal lines 806, 808 and 810 bringing signals from the motor HOIST port 670, from the motor lower port 672 and from the operator's control sensor 674, respectively. In addition, data lines 812 may connect the electronic control unit to the operator console 678 both for receiving commands and for sending information for display to the operator. Finally, brake control lines 814 may be connected between the electronic control unit and the proportional valve 680 controlling the hydraulic release circuit for the auxiliary brake.

The monitoring section 802 receives the input and output speed signals 688 and 690, respectively, and processes the speed signals to produce a calculated ratio of the actual rotational speed of the input shaft to the actual rotational speed of the output shaft. Typically, the input and output speed signals are conditioned using a conventional signal processing technology to avoid undue misinterpretation due to gear train wind up oscillation, etc. Once the monitoring section 802 has calculated the speed ratio between the input and output shafts, the ratio can be compared to the original fixed ratio of the gearbox which has been previously stored in memory. Whereas under ideal conditions, the speed ratio of a properly operating gear train will be exactly 100% of the original fixed ratio, under actual field conditions, various measurement errors from the Hall-effect device, signal interference or other factors can cause errors. In order to reduce the occurrence of "false positives", the EWMS measures the difference between the calculated speed ratio and the stored predetermined fixed ratio and signals a fault only when the value of this difference exceeds a pre-determined acceptable range value. For example, if the pre-determined acceptable range value is plus or minus 5%, then a gear train fault would be indicated when the measured speed ratio (the ratio of actual input speed to actual output speed) was greater than 105% of the pre-determined fixed rate or less than 95% of the pre-determined fixed rate. The exact value of acceptable range will be determined according to a number of factors, such as the reliability of the speed measurement sensors, of the magnitude of the potential consequences caused by a winch failure, and the tolerance of the operators to clearing false positives.

The EWMS may calculate an instantaneous speed ratio, i.e., based on single measurements of input shaft speed and output shaft speed (taken at the same time), however, this is not preferred for use in gear train fault detection. This is due to the fact that data "dropouts," interference and other transient events, while short-lived, are relatively common. Thus gear train fault detection using instantaneous real time measurements to calculate the speed ratio are prone to produce "false positives" (i.e., fault indications when no actual gear train failure has occurred). These false positives can become annoying to the operator if too common, and have the potential to induce the operator to bypass the EWMS (not desirable).

To reduce the incidence of "false positive" gear train fault indications due to transient measurement errors, in some embodiments the EWMS calculates the speed ratio using various data-conditioning processes. Two such conditioning processes that may be employed in the current invention are "simple" sampling windows and "averaging" sampling windows.

In the "simple" sampling window process, the control unit 668 specifies a sample window "size" (i.e., number of samples or time duration), and then does not produce a gear train fault indication signal unless the difference between the calculated speed ratio and the fixed ratio continuously exceeds the acceptable range for all samples taken during the sample period. For example, for a sampling rate of 60 Hz and a sample window size of 500 ms, thirty consecutive "out-of-range" speed ratio samples (i.e., those falling outside the allowable difference range compared to the fixed ratio) are required to produce a fault indication. Any time a sample is taken that has a speed range falling within the allowable difference range, the window is "re-set," and another thirty out-of-range samples must be taken before a fault is indicated.

Due to certain characteristics of Hall-effect sensors, the incidence of transient measurement errors is much greater when measuring relatively low winch drum speeds. Using a larger (i.e., longer) measurement sample window to calculate speed ratios will help reduce the incidence of false positive errors at such low winch speeds, although the longer sampling time window delays the application of the auxiliary brake. Fortunately, this long sampling window is only required at very low drum speeds, i.e., within the range from about 1 ft/min. to about 40 ft/min. (bare drum). At these low speeds, the resulting increase in stopping distances are typically acceptable at moderate loads. At higher winch speeds, where transient measurement errors are less common, a longer measurement window is not really needed, and a shorter sampling window may be advantageous in producing shorter stops.

In view of these considerations, in some embodiments, the EWMS addresses the issue of whether to use long or short sampling windows for speed ratio measurement by changing the length of the sampling window dynamically during winch operation. Typically, as the winch speed increases, the electronic control unit 668 automatically decreases the sampling window size or number of samples required. For example, in one preferred embodiment, at very low winch speeds, i.e.,just above 0 RPM, the sampling window may be as large as about 2000 ms. As the winch speed increases from about 0 RPM to around 20 RPM, the sampling window size is steadily reduced from about 2000 ms to about 60 ms. At winch speeds above about 20 RPM, the advantages of even smaller sample windows begin to diminish, so a relatively constant sample window size is maintained at these higher speeds. It will be appreciated that many other dynamic speed versus sampling window size relationships may be used.

Unlike the "simple" sample window process just described, in the "averaging" sample window process it is not necessary that all speed ratio samples taken during the window be "out-of-range" to cause a fault indication. Rather, in the average sampling window process, the fault test is now based on the average results of a number of calculated speed ratio values taken during the sampling window. For example, if the sampling frequency of the monitoring section 802 is 60 Hz, then a sampling window of 1 sec. will use a calculated speed ratio based on 60 pairs of individual measurements of the input and output shaft speeds, and a sampling window of 500 ms (0.500 sec.) will use a calculated speed ratio based on 30 pairs of measurements. The calculated average speed ratio is then compared to the fixed ratio as previously described to determine if a fault condition exists.

It will be appreciated that even if the average rotational speed of the winch is changing during the measurement sampling window, this does not affect the accuracy of the average speed ratio because the ratio of the respective input and output speeds in each pair of measurements should be constant, regardless of the winch speed (for an intact gear train).

Regardless of the process used, when the calculated speed ratio differs from the predetermined fixed ratio by more than the predetermined range value, the electronic control unit 668 of the EWMS recognizes this condition as a possible gear train failure and produces a fault indication signal. Upon receiving such a fault indication signal, the brake control section 804 of the control unit automatically acts to engage the auxiliary brake and bring the movement of the winch drum to a stop.

Referring again to FIG. 6, when the fault indication signal is produced, the brake control section 804 sends and electrical signal, e.g., via line 814, to the auxiliary brake release control valve 680. The brake control valve 680 is a proportional pressure control valve of conventional design capable of producing very accurate pressures in the hydraulic circuit 682 in response to the electrical current received on control line 814. The signals from the control unit 668 cause the control brake valve 680 to reduce the hydraulic pressure in the brake release circuit 682. As previously described, the auxiliary brake is spring applied and hydraulically released. Thus, as the brake release circuit pressure is reduced, the bias of the springs 656 force the brake friction and spacer plates 652 and 654, which are initially separated, toward one another. If the brake circuit pressure continues to be reduced, the plates 652*a* and 654 in the auxiliary brake 612 are first brought into contact, and then pressed together with increasing force until the brake piston 658 is completely retracted and the brake springs 656 are pressing at their maximum force to produce maximum stopping torque.

While in some cases it is desirable to apply the auxiliary brake as rapidly as possible, under many conditions, e.g., with a fractional-capacity load such as a typical 1000 to 2000 pound man-basket as previously described, the overly rapid application of the auxiliary brake 612 may cause undesirable high deceleration (G-forces) during stopping. This can be true in the lowering mode or in the hoisting mode, when sudden stops can cause severe and possibly dangerous "bounce" in the load and cable.

To smooth the deceleration (G-forces) experienced during automatic winch stoppages (such as when a gear train failure is indicated), in some embodiments of the EWMS the brake control section 804 reduces the hydraulic pressure in the auxiliary brake release circuit 682 in accordance with a predetermined nonlinear pressure versus time profile.

Figure 9:
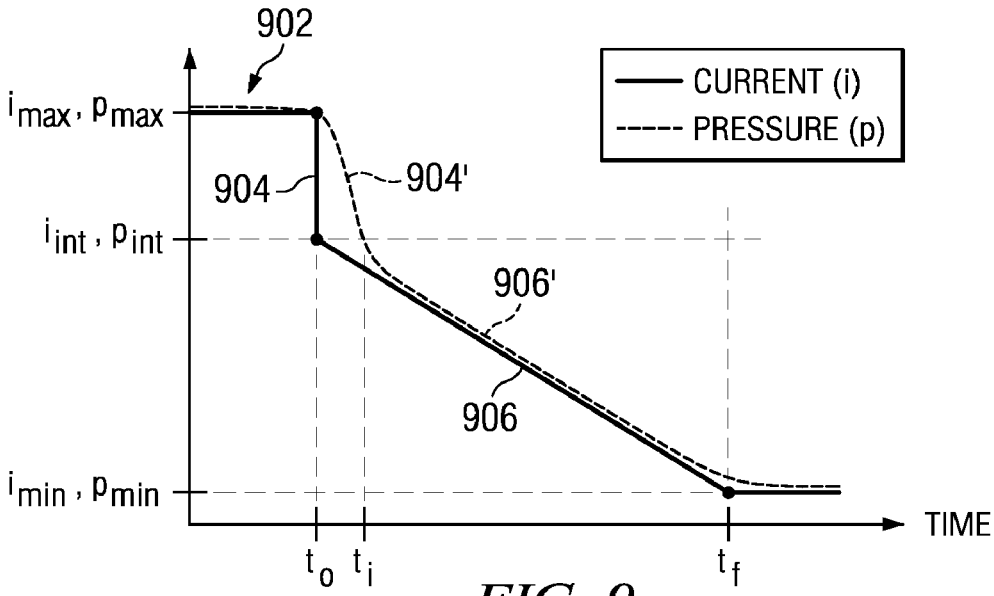
FIG. 9 is a graph of brake control current and brake release circuit pressure versus time in accordance with another embodiment.

Referring now to FIG. 9, there is illustrated a graph of a suitable nonlinear pressure versus time profile for the hydraulic pressure in the auxiliary brake release circuit 682. Also shown is a graph of the control current versus time for the brake control valve 680. The following quantities are shown:

$t_o$=time of initial fault indication signal $t_i$=time of initial contact between brake plates $t_f$=time of full engagement between brake plates $p_{max}$=maximum brake circuit pressure (brake springs fully compressed/plates fully disengaged)

$p_{int}$=intermediate brake circuit pressure (plates initially contact)

$p_{min}$=minimum brake circuit pressure (brake springs fully released/plates fully engaged)

$i_{max}$=maximum brake control current $i_{int}$=intermediate brake control current $i_{min}$=minimum brake control current It will be seen that the overall profile 900 of the pressure versus time profile comprises two distinct profile sections. In the section prior to the fault indication (designated 902), the current supplied to the hydraulic circuit proportional valve 680 is at $i_{max}$, and the corresponding pressure in the hydraulic brake release circuit 682 is $p_{max}$, fully retracting the brake piston 658 to allow the plates 652 and 654 to move out of contact with one another (separated by an oil film). At time $t=t_o$, the fault indication signal is received. This is the beginning of the first profile section of the predetermined pressure versus time profile, denoted 904. Upon receiving the fault indication signal, the electronic control unit 668 immediately reduces the brake control current from at $i_{max}$ to $i_{int}$, the current corresponding to $p_{int}$, where the brake plates first come into contact with one another (but don't produce any appreciable friction). It will be noted that, while the control current curve 904 drops essentially immediately, the pressure curve (denoted 904') may exhibit a time lag due to restrictions and flow characteristics of the hydraulic brake release circuit 682. Thus, the brake circuit pressure does not reach at $p_{int}$ until time at $t_i$. In experiments conducted on prototype EWMS, the values for $t_i$ were determined to range from about 0 ms to about 80 ms, depending upon the system.

The first pressure versus time profile section thus comprises the path 904' falling rapidly between the times $t_o$ and $t_i$.

After sending the brake control valve current to $i_{int}$, the control unit 668 initiates the second section of the pressure versus time profile, designated 906. This is the so-called "ramp" section previously referred to in connection with FIGS. 4 and 5. In this section, the brake valve control current is reduced linearly from $i_{int}$ to $i_{min}$ over a time period known as the "ramp time" extending between times $t_i$ and $t_f$. The ramp time is typically selected to provide the optimum stopping profile for the winch drum based on the sensed load (weight), winch direction and winch speed.

Since the brake control current changes slowly in the ramp profile section 906 compared to the first profile section 904, the corresponding pressure profile in the ramp section, denoted 906', can closely track the current's time profile, including it's linear character. Thus, the brake release circuit pressure is reduced at a substantially linear rate from $p_{int}$ to $p_{min}$ over the time interval $t_i$ to $t_f$.

After time $t_f$, the brake control current and brake release circuit pressure both remain constant at $i_{min}$ and $p_{min}$, respectively. At this point, the auxiliary brake piston 658 is fully retracted and no longer exerts any counteracting force on the brake springs 656, which are applying their full force against the brake plates 652 and 654.

The use of a nonlinear pressure versus time profile for the reduction of pressure in the auxiliary brake release circuit 682, comprising first section 904' and second linear "ramp" section 906', allows some embodiments of the EWMS to produce a winch drum stopping profile that reduces the deceleration (G-forces) based on the measured load, winch direction and speed. In experimental prototypes, ramp times within the range from about 120 ms to about 6000 ms have been used successfully. For loads approximating man-basket applications, ramp times within the range from about 1500 ms to about 5000 ms have proven well suited to minimizing G-forces.

Where the ramp time and profile are to be determined dynamically in the control unit 668, the measured load is typically determined by comparing the sensed differential pressure between the motor's HOIST port (line 807) and LOWER port (line 808) and utilizing stored information regarding the motor's torque characteristics. Winch direction (HOIST or LOWER) may be determined by sensing the operator's control position (line 810) or from the control software. Winch drum speed may be sensed using the output speed sensor (line 690). The rope layer position may be sensed, if desired, using a rope layer sensor 56 (FIG. 2).

In some embodiments, the electronic control unit 668 may use real-time values of winch operational parameters to calculate the desired ramp time and associated nonlinear pressure versus time profile for stopping the winch drum. In other embodiments, however, the control unit 668 further comprises a buffer section 816 including a plurality of memory locations 818 for the temporary storage of winch parameters. Depending on the memory allocated, the buffer 816 section can retain winch operating parameters for a relatively long period of time (e.g., 500 ms or longer). If a fault indication signal is produced, data corresponding to winch operational parameters existing just before the fault may be retrieved from the buffer section 816 and used to calculate a desirable ramp time and pressure versus time profile for stopping the winch drum.

Figure 10:
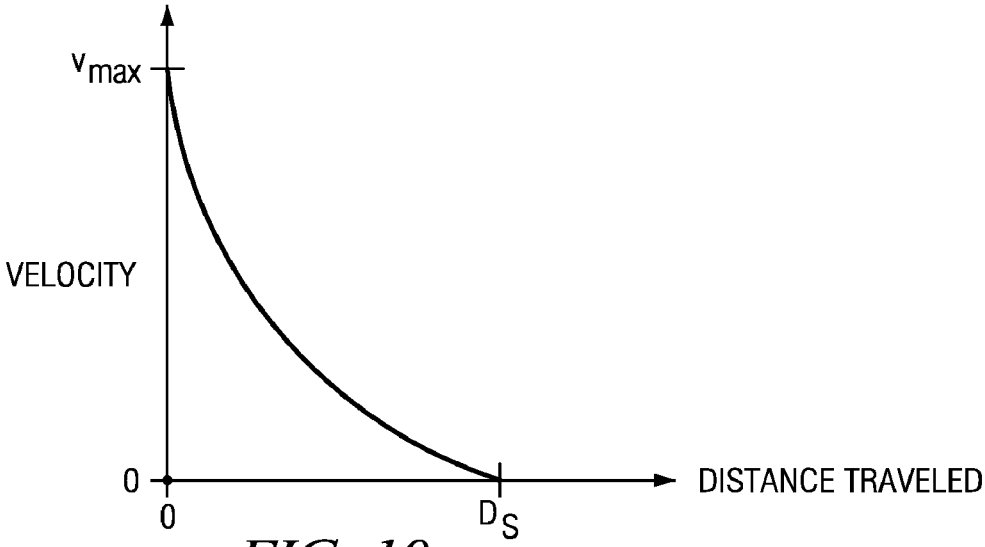
FIG. 10 is a graph of winch velocity versus distance traveled in accordance with another embodiment.

The equations previously disclosed in connection with FIGS. 4 and 5 provide one method of calculating the optimum ramp times for specific winching conditions, and hence for calculating the entire nonlinear pressure versus time profile described in connection with FIG. 9. It will be appreciated that other forms of equations may also be used for calculating the nonlinear pressure versus time profile disclosed in FIG. 9 for releasing the pressure on the auxiliary brake circuit in the current invention. It is believed that suitable equations will provide a load velocity versus distance curve having a substantially parabolic profile as illustrated in FIG. 10, wherein:

Velocity=load velocity

Distance=distance traveled by load after initial brake application $v_{max}$=load velocity at time of initial brake application $D_S$=total stopping distance after initial brake application Another aspect of the current invention is a diagnostic subsystem that can be used after a fault indication induced stoppage to test whether the incident is a true gear train failure or simply a false positive. The diagnostic subsystem preferably takes control of the winch upon a fault indication, and will not release control back to the operation until a series of diagnostic tests have been run and passed. The subsystem also logs the test results into the EWMS memory for later retrieval and review.

Figure 11A:
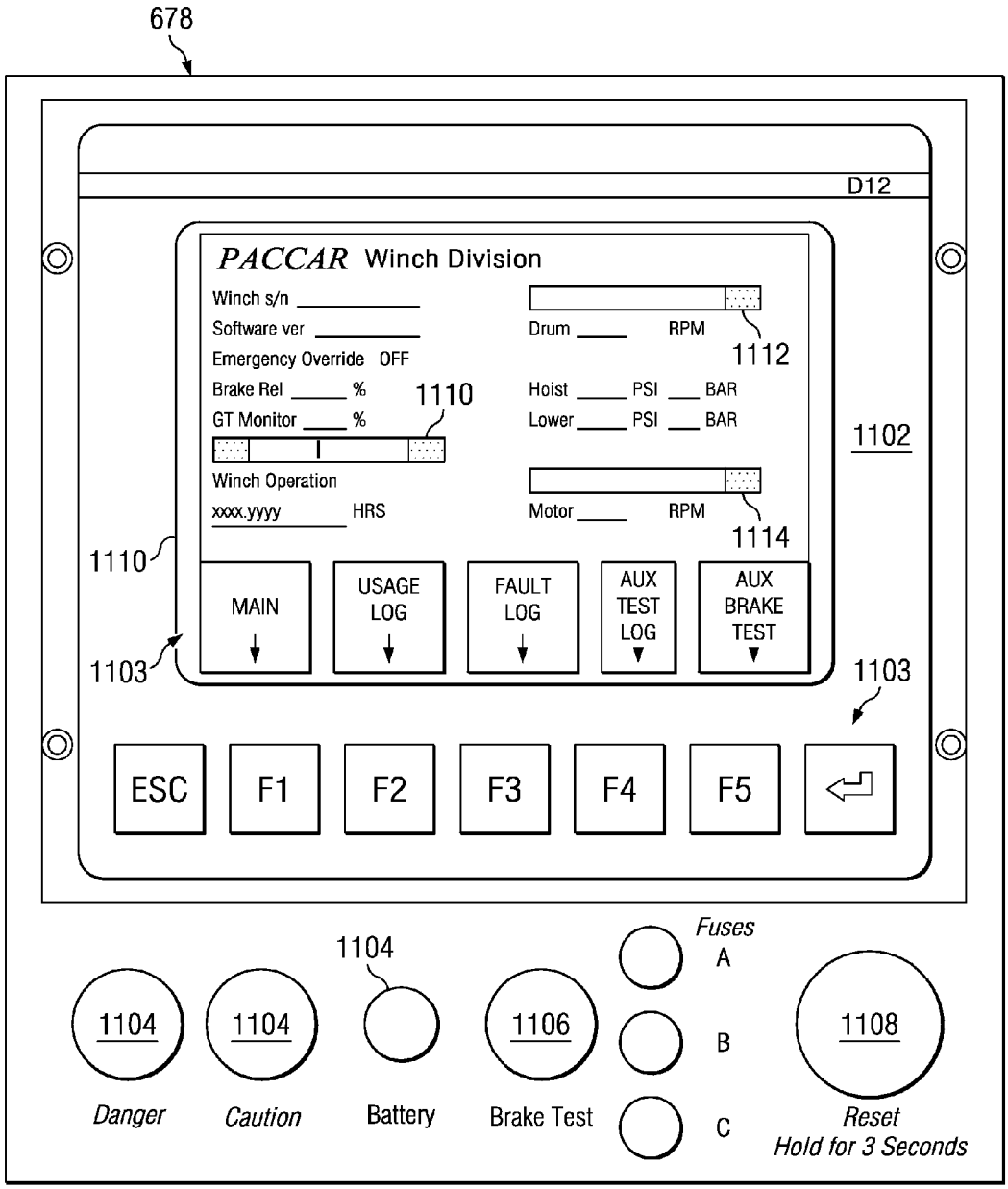
FIGS. 11*a* and 11*b* are diagrams of an operator display console for an electronic winch monitoring system in accordance with another embodiment.
Figure 11B:
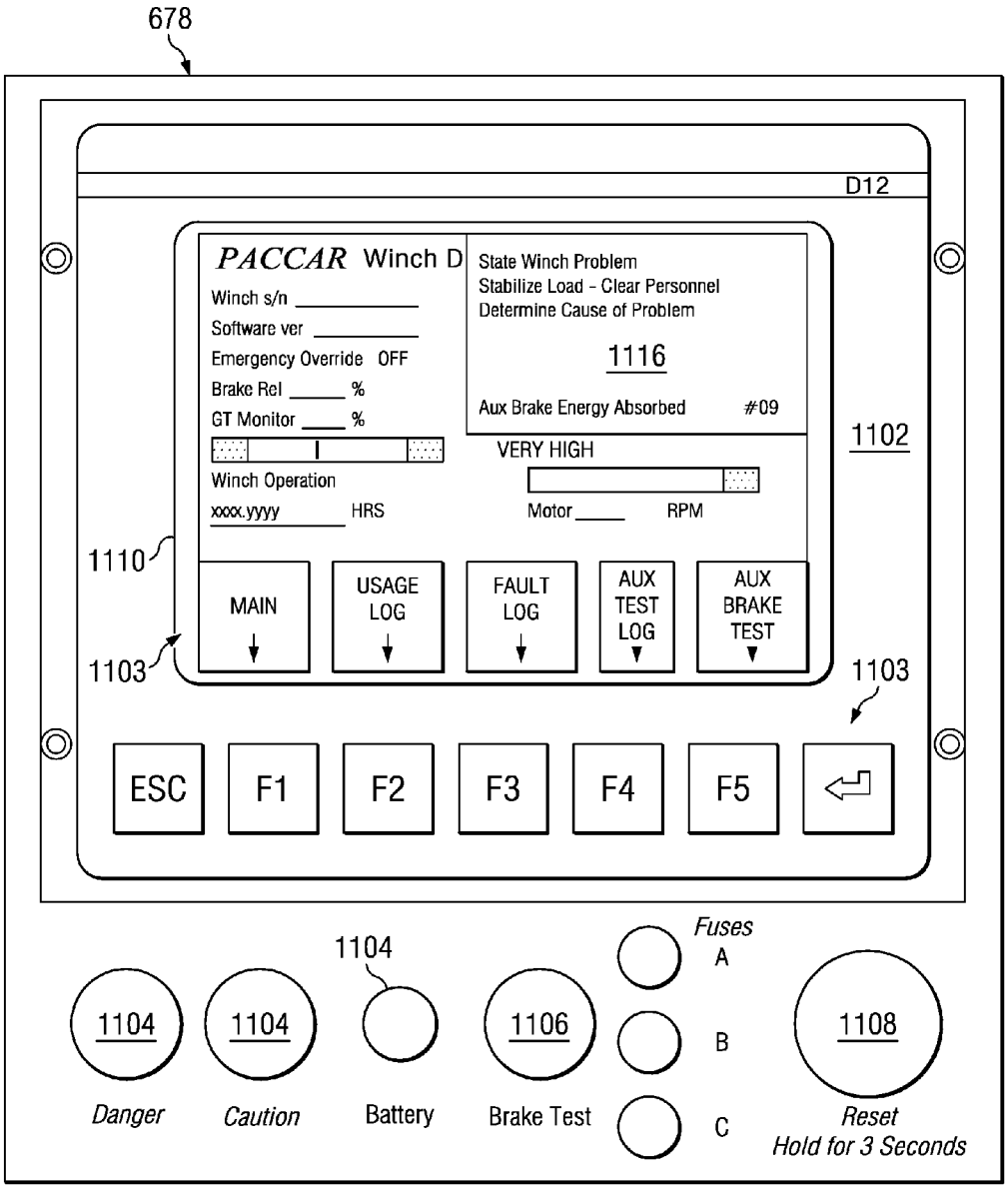

Referring now to FIGS. 11*a* and 11*b*, there are illustrated enlarged views of the operator console 678 for the EWMS in accordance with another embodiment. The console 678 includes an input/output panel 1102 including context-sensitive (programmable) touch-screen buttons 1103 for operator control and information functions. The console 678 further includes an array of indicator lights 1104 and hard-wired switches 1106 and 1108. FIG. 11*a* illustrates the console 678 in a normal operating mode, displaying on the panel 1102 both numerical and graphical information regarding operational winch parameters such as speed ratio, drum speed and motor speed (graphs 1110, 1112 and 1114, respectively). FIG. 11*b* illustrates the console after a gear train fault indication has caused the EWMS to automatically take control from the operator and stop the winch. A "drop down" window 1116 has now appeared on the display 1102, providing the operator with information regarding the fault and instructions for further action. Many other display screens can be provided, including those instructing the operator to perform diagnostic tests of the winch following a gear train fault indication as described below.

Referring now to FIGS. 12*a*–12*d*, there is illustrated a flow chart of the winch diagnostic subsystem in accordance with another embodiment. As previously described, the winch diagnostic subsystem may be used whenever a gear train fault indication has caused winch operation to stop. The purpose of the winch diagnostic subsystem is to sequentially test the integrity of the winch gearbox and to log the test results by first checking for degrees of fractured gear train components starting at the motor end. If the winch passes these tests successfully, the system slowly releases the auxiliary brake over several seconds and confirms smooth rotation of the drum under light load. It will be appreciated that the exact text of operator instructions shown in this embodiment is for illustrative purposes only, and may be replaced with other similar language without departing from the scope of the invention.

Figure 12A:
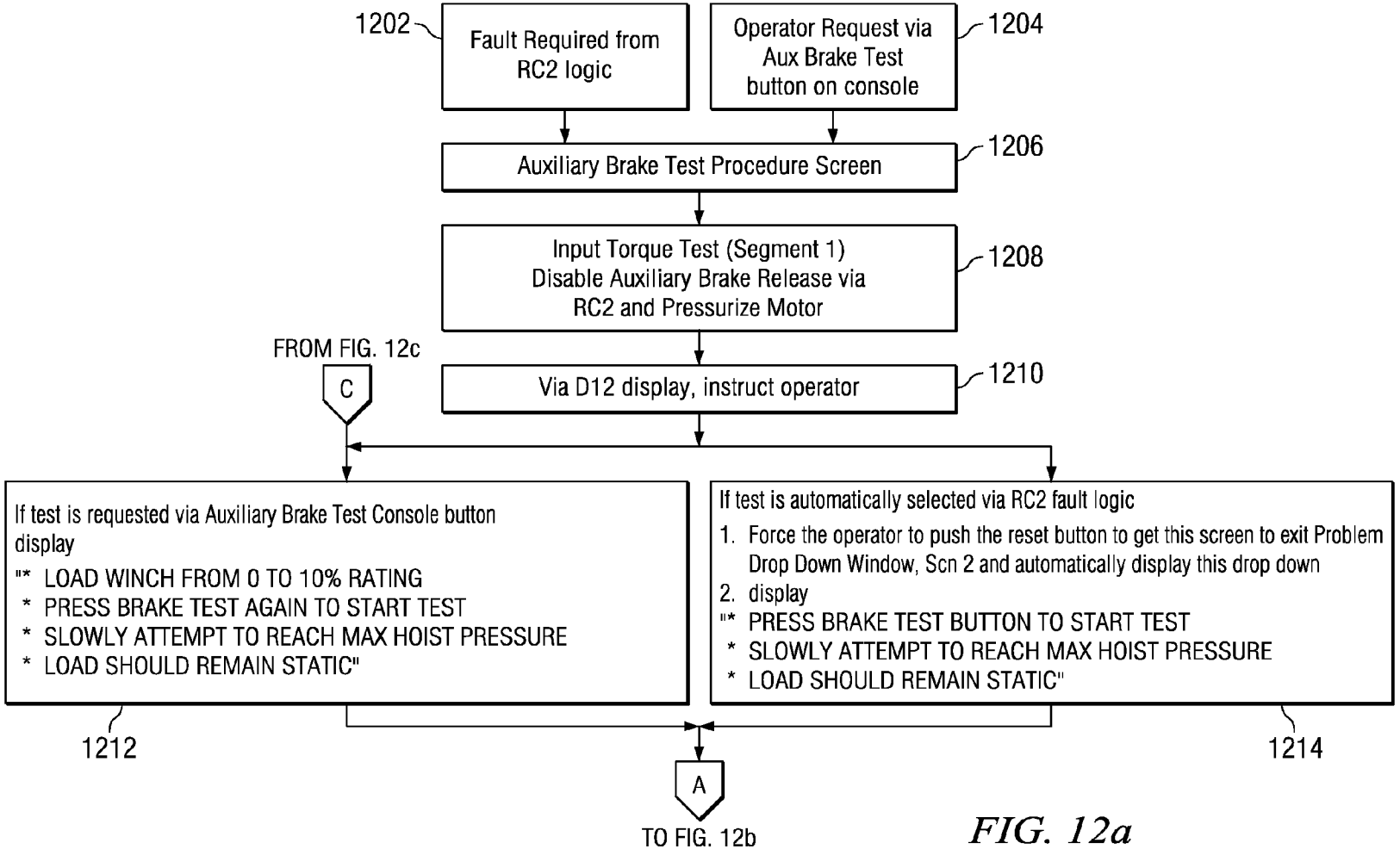
FIGS. 12*a*–12*d* are block diagrams of the winch diagnostic subsystem in accordance with another embodiment.
Figure 12B:
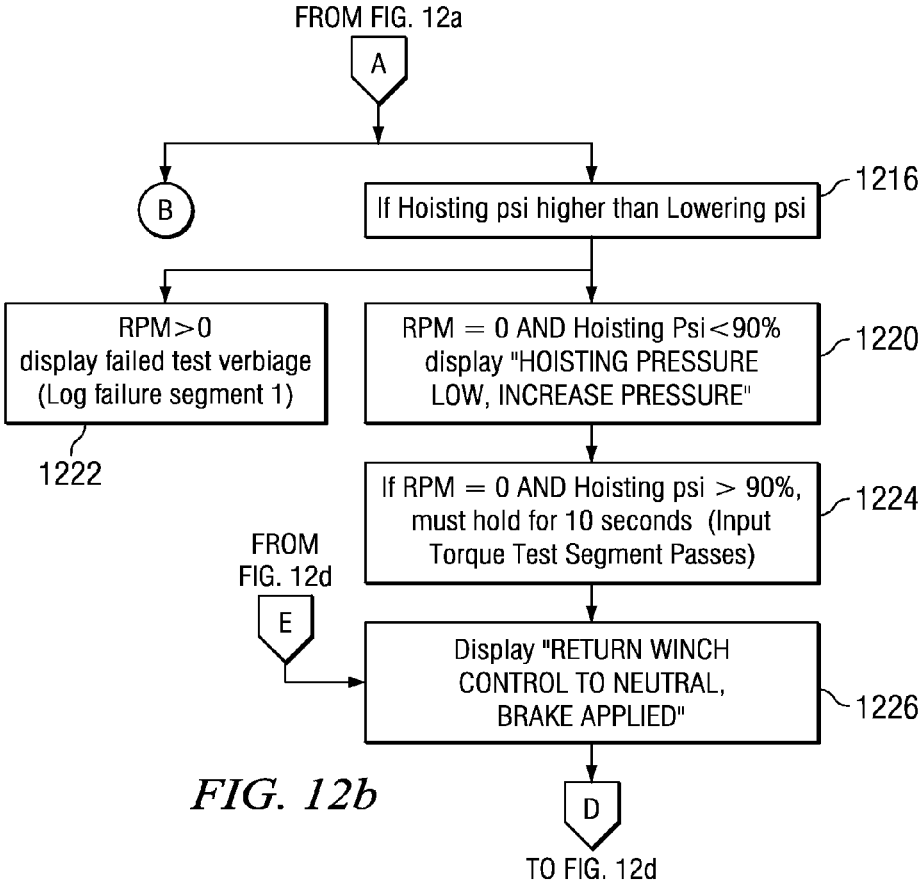
Figure 12C:
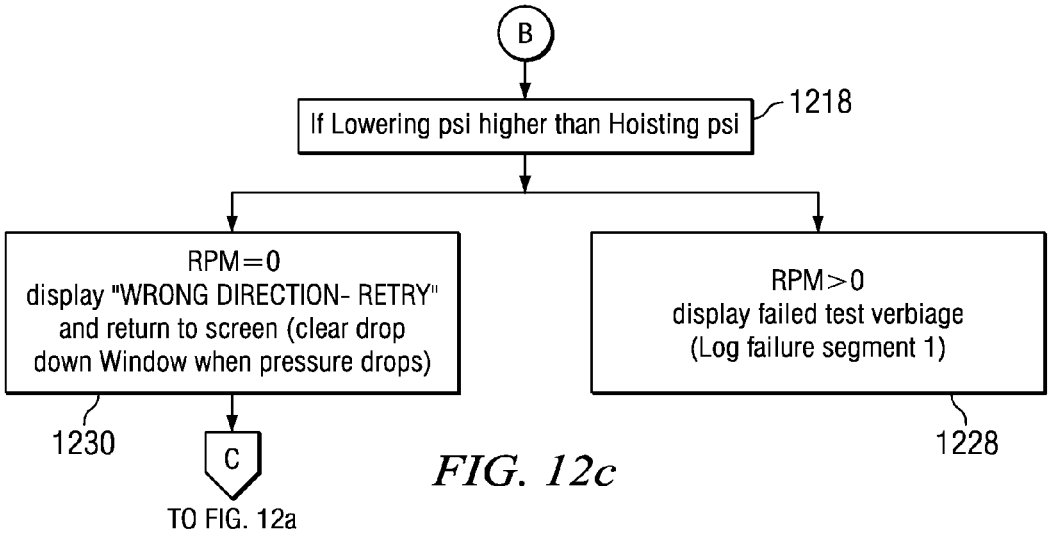

Referring first to FIG. 12*a*, the alternative conditions for initiating the winch diagnostic subsystem are shown. First, as shown in box 1202, a fault indication may be received from the electronic control unit (referred to in this case as the "RC2" processor). This fault indication will have caused operation of the winch to be halted. As shown in box 1204, the winch diagnostic subsystem may also be voluntarily activated by the operator using the auxiliary brake test button on the console 678. Once initiated, the auxiliary brake test procedure screen appears on the console as indicated by box 1206. The test then proceeds to block 1208 wherein the input torque test is initiated.

The input torque test consist of disabling the automatic auxiliary brake release via the electronic control unit and pressurizing the winch motor. Moving now to block 1210, the system now displays operator instructions on the operator display 678. The nature of the instructions displayed is dependent upon the conditions which initiated the brake test procedure. As shown in block 1212, if the test was requested via the auxiliary brake test console button, then the following or similar instructions are displayed: "LOAD WINCH FROM 0–10% RATING; PRESS BRAKE TEST AGAIN TO START TEST; SLOWLY ATTEMPT TO REACH MAX HOIST PRESSURE; LOAD SHOULD REMAIN STATIC." On the other hand, if the test was automatically selected via the electronic control unit fault logic, then the system first forces the operator to push the reset button to get the screen to exit the "problem drop-down window" (see FIG. 11*b*) and automatically display the drop-down as follows (or similar): "PRESS TEST BRAKE BUTTON TO START TEST; SLOWLY ATTEMPT TO REACH MAX HOIST PRESSURE; LOAD SHOULD REMAIN STATIC." Following this display, the system operation proceeds via connector A to either block 1216 (of FIG. 12*b*) or block 1218 (of FIG. 12*c*) depending on the relationship between the sensed hoisting pressure and the sensed lowering pressure.

If the sensed hoisting pressure is higher than the sensed lowering pressure, as represented in block 1216, then operation proceeds to either block 1220 or 1222, depending on the measured RPM on the input shaft 604. As indicated in block 1220, if the input shaft RPM equals zero, and the hoisting pressure is less than 90% of max, then the operator display shows the following (or similar): "HOISTING PRESSURE LOW, INCREASE PRESSURE." This indicates that no fault has been found in the gear train, however, hoisting pressure is not high enough for a valid test. Under these circumstances, the operator must increase the hoisting pressure until it exceeds 90% of the maximum in order to move to the next block of the test procedure. As shown in block 1224, once conditions of: a) zero RPM on the input shaft; and b) the hoisting pressure being greater than 90% of max are maintained for ten seconds, then the winch system passes the input torque test segment. Operation then proceeds to block 1226 in which the operator display 678 displays the following "RETURN WINCH CONTROL TO NEUTRAL, BRAKE APPLIED."

Returning to the decision represented by block 1216, in the alternative block 1222, it is shown that if the RPM of the input shaft 604 is greater than zero while the auxiliary brake is engaged, this represents a gear train failure detection. The system will now display on the operator's console verbiage indicating "test failed." In addition, the system will log the failure of test segment one. Under these conditions, control of the winch will not be returned to the operator until service technicians diagnose the problem or unless appropriate safety overrides are engaged.

Returning to the decision point alternative block 1218, if the lowering pressure is higher than the hoisting pressure, a new set of decisions is encountered as represented by blocks 1228 and 1230. As indicated in block 1228, if the RPM detected at the input shaft 604 is greater than zero, then this indicates a gear train failure and the system will display verbiage on the operator's console indicating "test failed." In addition, the system will log the failure of test segment one. In the alternative shown in block 1230, if the RPM equals zero, the inversion of hoisting and lowering pressures indicates that the operator has attempted to move the winch in the wrong direction. Under these conditions, the system displays the following instructions (or similar): "WRONG DIRECTION—RETRY" on the operator's console and routes the program via connector C back to block 1212 (FIG. 12*a*) where the test resumes as previously described.

Figure 12D:
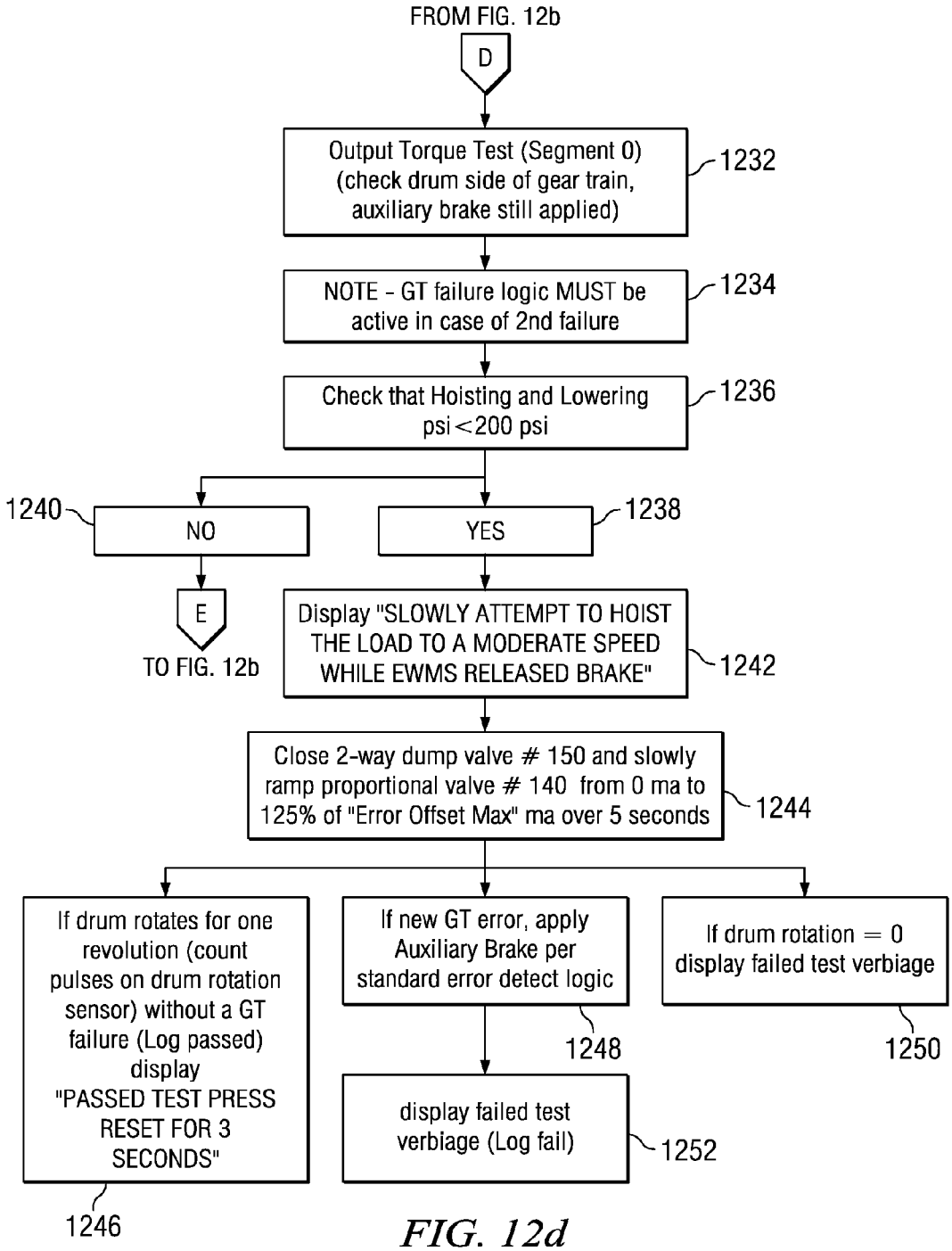

If the winch system passes the first section of the test as indicated by reaching block 1224, operation then proceeds to the initiation of the second phase of the test. As indicated in block 1226, the second test is initiated by displaying on the operator's console the following instructions (or similar): "RETURN WINCH CONTROL TO NEUTRAL, BRAKE APPLIED." Operation then passes through connector D to block 1232 (FIG. 12*d*). Block 1232 represents the beginning of the output torque test. The purpose of the output torque test is to check the drum side of the gear train with the auxiliary brake still applied. Operation of the test proceeds to block 1234 where it is noted that the gear train failure logic must be active in case a second failure is detected during the course of the test. Proceeding now to block 1236, the system checks to see that the hoisting and lowering pressure is less than 200 psi as shown by the decision represented by alternative blocks 1240 and 1238, the test proceeds as shown in block 1238 if the hoisting and lowering pressure are lower than 200 psi and operation proceeds to block 1242, whereas if the hoisting and lowering pressure were greater than 200 psi, operation proceeds to block 1240, which routes operation through connector E back to block 1226 (FIG. 12*b*) to restart the output torque test.

The test proceeds by first displaying instructions to the winch operator via the operator's console 678 as follows (or similar): "SLOWLY ATTEMPT TO HOIST THE LOAD TO A MODERATE SPEED WHILE EWMS RELEASED BRAKE." The operation continues in block 1244 where the EWMS slowly adds pressure to the brake release circuit thereby reducing the friction of the auxiliary brake by a small amount as the operator continues to try and slowly hoist a load. For safety purposes, the auxiliary brake is released very slowly over a period of approximately five seconds to avoid any sudden movements of the load in case a gear train failure has occurred. The outcome of the test is now assessed by the alternative decision blocks represented by blocks 1246, 1248 and 1250. As indicated in block 1246, if the winch drum 610 rotates for one revolution, as indicated by signals received from the output speed sensor without occurrence of a new gear train failure fault indication, then the winch system has passed the output torque test. The system logs that the test has been passed and displays an operator message as follows (or similar): "PASSED TEST PRESS RESET FOR 3 SECONDS." As indicated, the operator may now recover normal operation of the winch by pressing the reset button for the specified period of time. On the other hand, as indicated in block 1248, if a new gear train fault indication occurs during this test, the system will apply the auxiliary brake in accordance with its standard EWMS error detection logic. Operation will then proceed to block 1252 where the system will notify the operator that the winch test has failed and log the failure. As indicated in the third decision block 1250, if no drum rotation occurs, i.e., output speed equals zero as indicated by the output speed detector, this is also indicative of a gear train failure and the system will indicate to the operator that the test has been failed and log the failure in the system.

While the invention has been shown or described in a variety of its forms, it should be apparent to those skilled in the art that it is not limited to these embodiments, but is susceptible to various changes without departing from the scope of the invention.

What is claimed is:

1. An electronic winch monitoring system for a winch mechanism including a gearbox of predetermined fixed ratio between a rotatable input shaft and a rotatable output shaft, a primary brake operatively connected to the input shaft for selectively stopping rotational motion of the input shaft when activated, a rotatable winch drum operatively connected to the output shaft to rotate therewith for selectively winding on and winding off cable stored on the drum to hoist and lower loads, respectively, and an auxiliary brake operatively connected to the output shaft for selectively stopping, when activated, rotational motion of the winch drum independent of the action of the primary brake, the electronic winch monitoring system comprising:

an input speed sensor for detecting an actual rotational speed of the input shaft and producing input speed signals indicative of thereof;

an output speed sensor for detecting an actual rotational speed of the output shaft and producing output speed signals indicative thereof;

a sensor for determining a currently selected hoisting direction and producing hoisting direction signals indicative thereof;

an electronic control unit including a monitoring section and a brake control section;

the monitoring section receiving the input speed signals, output speed signals and hoisting direction signals, and processing the speed signals and hoisting direction signals to produce a calculated position of the end of the cable, the monitoring section further processing the speed signals to produce a calculated ratio of the actual rotational speed of the input shaft to the actual rotational speed of the output shaft, and producing a fault indication signal when the value of the difference between the calculated ratio and the predetermined fixed ratio exceeds a predetermined acceptable range value; and the brake control section, upon receiving the fault indication signal, activating the auxiliary brake to stop rotation of the drum with an acceleration profile based on output speed signals and hoisting direction signals received prior to the fault indication signal.

2. An electronic winch monitoring system in accordance with claim 1, wherein the acceleration profile is selected to stop rotation of the drum in the shortest distance possible without exceeding a predetermined maximum acceleration.

3. An electronic winch monitoring system in accordance with claim 1, wherein the input acceleration profile is selected to stop rotation of the drum using the lowest acceleration necessary to prevent the calculated position of the end of the cable from reaching a predetermined position level.

4. An electronic winch monitoring system in accordance with claim 3, wherein the predetermined position level is the minimum safe level beneath the load.

5. An electronic winch monitoring system in accordance with claim 1, wherein the input speed sensor is mounted on a portion of the gearbox proximate to the input shaft to directly detect the actual rotational speed of the input shaft.

6. An electronic winch monitoring system in accordance with claim 1, wherein the input speed sensor is mounted on a portion of a hydraulic motor proximate to a motor output shaft to detect the actual rotational speed of the motor output shaft, wherein the motor is operably connected to the gearbox such that the motor output shaft rotates with gearbox input shaft, and whereby the actual rotational speed of the motor output shaft detected by the input speed sensor is also indicative of the actual rotational speed of the gearbox input shaft.

7. An electronic winch monitoring system in accordance with claim 1, wherein the calculated ratio is produced by comparing a single sample of the actual rotational speed of the input shaft at a single time value to a single sample of the actual rotational speed of the output shaft at the same time value.

8. An electronic winch monitoring system in accordance with claim 1, wherein the calculated ratio is produced by comparing an average of n samples of the actual rotational speed of the input shaft over a period of n time values to an average of n samples of the actual rotational speed of the output shaft over the same period.

9. An electronic winch monitoring system in accordance with claim 8, wherein a plurality of values of n are associated with corresponding plurality of ranges of the rotational speed of the output shaft, and the value of n used by the monitoring section is the value of n associated with the range containing the current rotational speed of the output shaft.

10. An electronic winch monitoring system in accordance with claim 9, wherein the successive values of n in the plurality of values of n decrease as the rotational speeds within the associated plurality of ranges of the rotational speed of the output shaft increases.

11. An electronic winch monitoring system for a winch mechanism including a gearbox establishing a driving connection of predetermined fixed ratio between a rotatable input shaft and a rotatable output shaft, a primary brake connected to the input shaft for selectively resisting rotational motion of the input shaft when activated, a rotatable winch drum operatively connected to the output shaft to rotate therewith for selectively winding on and winding off cable stored on the drum, respectively, and an auxiliary brake operatively connected to the output shaft for selectively resisting rotational motion of the winch drum when activated, the electronic winch monitoring system comprising:

an input speed sensor for detecting an actual rotational speed of the input shaft and producing input speed signals indicative of thereof;

an output speed sensor for detecting an actual rotational speed of the output shaft and producing output speed signals indicative thereof;

an electronic control unit including a monitoring section and a brake control section;

the monitoring section receiving the input and output speed signals, processing the speed signals to produce a calculated ratio of the actual rotational speed of the input shaft to the actual rotational speed of the output shaft, and producing a fault indication signal when the value of the difference between the calculated ratio and the predetermined fixed ratio exceeds a predetermined acceptable range value;

the brake control section, upon receiving the fault indication signal, activating the auxiliary brake in accordance with a predetermined nonlinear braking versus time profile to stop rotation of the winch drum, the predetermined nonlinear braking versus time profile including a first profile section having a first time length during which the braking force is rapidly increased from a minimum force to an intermediate force, and a second profile section following the first profile section, the second profile section having a second time length during which the braking force is increased at a substantially linear rate from the intermediate force to a maximum force.

12. An electronic winch monitoring system in accordance with claim 11, wherein the first time length of the first profile section is within the range from about 0 milliseconds to about 80 milliseconds.

13. An electronic winch monitoring system in accordance with claim 12, wherein the second time length of the second profile section is within the range from about 120 milliseconds to about 6000 milliseconds.

14. An electronic winch monitoring system in accordance with claim 13, wherein the second time length of the second profile section is within the range from about 1500 milliseconds to about 5000 milliseconds.

15. An electronic winch monitoring system for a winch mechanism including a gearbox of predetermined fixed ratio having a rotatable input shaft and a rotatable output shaft, a primary brake operatively connected to the input shaft, a rotatable winch drum operatively connected to the output shaft, and an independent auxiliary brake operatively connected to the output shaft for selectively resisting rotational motion of the winch drum when activated, the electronic winch monitoring system comprising:

an input speed sensor for detecting rotational speed of the input shaft and producing input speed signals indicative of an input speed value at the current time;

an output speed sensor for detecting rotational speed of the output shaft and producing output speed signals indicative of an output speed value at the current time;

a sensor for determining hoisting direction and producing hoisting direction signals indicative of the hoisting direction at the current time;

an electronic control unit including a monitoring section and a brake control section;

the monitoring section receiving the input and output speed signals, processing the speed signals to produce a calculated ratio of the rotational speed of the input shaft to the rotational speed of the output shaft, and producing a fault indication signal when the value of the difference between the calculated ratio and the predetermined fixed ratio exceeds a predetermined acceptable range value;

the brake control section, upon receiving the fault indication signal, activating the auxiliary brake to stop rotation of the winch drum in accordance with a predetermined braking-time profile;

a buffer memory included within the monitoring section for temporarily storing a plurality of successive past values of the output speed and corresponding past values for the hoisting direction; and wherein, when a fault indication signal is produced, past values of the output speed and of the hoisting direction corresponding to a time before the fault indication signal was produced are retrieved from the buffer and used to produce the braking-time profile.

16. An electronic winch monitoring system in accordance with claim 15, wherein the braking-time profile is selected to stop rotation of the drum in the shortest distance possible without exceeding a predetermined maximum acceleration.

17. An electronic winch monitoring system in accordance with claim 15, wherein the braking-time profile is selected to stop rotation of the drum using the lowest acceleration necessary to prevent the end of the cable from reaching a predetermined position level.

18. An electronic winch monitoring system in accordance with claim 17, wherein the predetermined position level is the minimum safe level beneath the load.

* * * * *